US008111835B2

(12) United States Patent
Inoue et al.

(10) Patent No.: US 8,111,835 B2
(45) **Date of Patent: *Feb. 7, 2012**

(54) ACTIVE NOISE CONTROL APPARATUS

(75) Inventors: Toshio Inoue, Wako (JP); Akira Takahashi, Wako (JP); Kosuke Sakamoto, Wako (JP); Yasunori Kobayashi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 955 days.

This patent is subject to a terminal disclaimer.

(21) Appl. No.: 12/058,050

(22) Filed: Mar. 28, 2008

(65) Prior Publication Data

US 2008/0240455 A1 Oct. 2, 2008

(30) Foreign Application Priority Data

Mar. 30, 2007 (JP) ..... 2007-093848

(51) Int. Cl.

| | |
|---|---|
| ***G10K 11/16*** | (2006.01) |
| ***G10K 11/175*** | (2006.01) |
| *G10K 11/00* | (2006.01) |
| *G10K 11/178* | (2006.01) |

(52) U.S. Cl. ..... 381/71.4; 381/71.11; 381/71.12

(58) Field of Classification Search ..... 381/71.4, 381/71.8, 71.9, 71.11, 71.12, 86, 94.1, 94.7, 381/94.9

See application file for complete search history.

(56) References Cited

U.S. PATENT DOCUMENTS

| | | | | |
|---|---|---|---|---|
| 5,105,377 | A * | 4/1992 | Ziegler, Jr. | 708/300 |
| 6,625,285 | B1 * | 9/2003 | Ohashi | 381/71.3 |
| 6,944,303 | B2 | 9/2005 | Akiho | |
| 7,003,099 | B1 * | 2/2006 | Zhang et al. | 379/406.03 |
| 7,068,798 | B2 * | 6/2006 | Hugas et al. | 381/93 |
| 7,317,801 | B1 * | 1/2008 | Amir | 381/71.1 |
| 7,616,768 | B2 * | 11/2009 | Watson et al. | 381/71.4 |
| 7,716,046 | B2 * | 5/2010 | Nongpiur et al. | 704/226 |
| 7,885,417 | B2 * | 2/2011 | Christoph | 381/71.11 |
| 7,949,520 | B2 * | 5/2011 | Nongpiur et al. | 704/207 |
| 2004/0240678 | A1 * | 12/2004 | Nakamura et al. | 381/71.11 |
| 2004/0247137 | A1 | 12/2004 | Inoue et al. | |
| 2006/0056642 | A1 * | 3/2006 | Inoue et al. | 381/71.11 |
| 2007/0038441 | A1 * | 2/2007 | Inoue et al. | 704/226 |
| 2007/0140503 | A1 * | 6/2007 | Sakamoto et al. | 381/71.4 |
| 2008/0152158 | A1 * | 6/2008 | Sakamoto et al. | 381/71.4 |

(Continued)

FOREIGN PATENT DOCUMENTS

| | | |
|---|---|---|
| JP | 02-224500 | 9/1990 |

(Continued)

OTHER PUBLICATIONS

U.S. Appl. No. 12/058,094, filed Mar. 28, 2008.

*Primary Examiner* — Edgardo San Martin
(74) *Attorney, Agent, or Firm* — Rankin, Hill & Clark LLP

(57) ABSTRACT

A subtractor subtracts an echo canceling signal from a canceling error signal to estimate the resonant noise to be silenced at a position of a microphone, and outputs a first basic signal representing the estimated resonant noise as an input signal supplied to a controller. In the controller, a delay filter generates a second basic signal by delaying the first basic signal by a time value. The controller generates a control signal based on the first basic signal and the second basic signal.

15 Claims, 18 Drawing Sheets

U.S. PATENT DOCUMENTS

| | | | | |
|---|---|---|---|---|
| 2008/0192948 | A1* | 8/2008 | Kan et al. | 381/71.4 |
| 2008/0292110 | A1* | 11/2008 | Kobayashi et al. | 381/71.4 |
| 2008/0310650 | A1 | 12/2008 | Nakamura et al. | |

FOREIGN PATENT DOCUMENTS

| | | |
|---|---|---|
| JP | 05-039712 | 2/1993 |
| JP | 05-040482 | 2/1993 |
| JP | 05-046189 | 2/1993 |
| JP | 06-109066 | 4/1994 |
| JP | 08-109066 | 4/1994 |
| JP | 08-123437 | 5/1996 |
| JP | 11-325168 | 11/1999 |
| JP | 2000-099037 | 4/2000 |
| JP | 2000-322066 | 11/2000 |
| JP | 2001-282255 | 12/2001 |
| JP | 2003-241767 | 8/2003 |
| JP | 2004-361721 | 12/2004 |
| JP | 3630171 | 3/2005 |
| JP | 2007-025527 | 2/2007 |

* cited by examiner

| n | BUFFER 0 | BUFFER 1 | BUFFER 2 | BUFFER 3 | BUFFER 4 |
|---|---|---|---|---|---|
| 0 | 0 | 0 | 0 | 0 | 0 |
| 1 | (x) a1 | (x') 0 | 0 | 0 | 0 |
| 2 | a1 | (x) a2 | (x') 0 | 0 | 0 |
| 3 | a1 | a2 | (x) a3 | (x') 0 | 0 |
| 4 | a1 | a2 | a3 | (x) a4 | (x') 0 |
| 5 | (x') a1 | a2 | a3 | a4 | (x) a5 |
| 6 | (x) a6 | (x') a2 | a3 | a4 | a5 |
| 7 | a6 | (x) a7 | (x') a3 | a4 | a5 |
| 8 | a6 | a7 | (x) a8 | (x') a4 | a5 |
| ⋮ | ⋮ | ⋮ | ⋮ | ⋮ | ⋮ |
| ⋮ | ⋮ | ⋮ | ⋮ | ⋮ | ⋮ |
| i−1 | $a_{i-1}$ | $a_{i-5}$ | $a_{i-4}$ | $a_{i-3}$ | $a_{i-2}$ |
| i | $a_{i-1}$ | $a_i$ | $a_{i-4}$ | $a_{i-3}$ | $a_{i-2}$ |
| ⋮ | ⋮ | ⋮ | ⋮ | ⋮ | ⋮ |

FIG. 5

| SAMPLING EVENT n | INSTANTANEOUS VALUE | REGISTER 0 | REGISTER 1 | REGISTER 2 | REGISTER 3 | OLDEST DATA |
|---|---|---|---|---|---|---|
| 0 | 0 ↑ | 0 | 0 | 0 | 0 | ↑ 0 |
| 1 | a1 ↑ | a1 | 0 | 0 | 0 | ↑ 0 |
| 2 | a2 ↑ | a2 | a1 | 0 | 0 | ↑ 0 |
| 3 | a3 ↑ | a3 | a2 | a1 | 0 | ↑ 0 |
| 4 | a4 ↑ | a4 | a3 | a2 | a1 | ↑ 0 |
| 5 | a5 ↑ | a5 | a4 | a3 | a2 | ↑ a1 |
| ⋮ | ⋮ | ⋮ | ⋮ | ⋮ | ⋮ | ⋮ |
| i−1 | $a_{i-1}$ ↑ | $a_{i-1}$ | $a_{i-2}$ | $a_{i-3}$ | $a_{i-4}$ | ↑ $a_{i-5}$ |
| i | $a_i$ ↑ | $a_i$ | $a_{i-1}$ | $a_{i-2}$ | $a_{i-3}$ | ↑ $a_{i-4}$ |
| ⋮ | ⋮ | ⋮ | ⋮ | ⋮ | ⋮ | ⋮ |

ACTIVE NOISE CONTROL APPARATUS

BACKGROUND OF THE INVENTION

1. Field of the Invention

The present invention relates to an active noise control apparatus for reducing an in-compartment noise with a cancellation sound, which is opposite in phase to the in-compartment noise, and more particularly to an active noise control apparatus for reducing a drumming noise (hereinafter also referred to as "road noise"), which is generated in the passenger compartment of a vehicle while the vehicle is running.

2. Description of the Related Art

Heretofore, there has been known in the art an active noise control apparatus (hereinafter also referred to as a "periodic-noise-compatible ANC") for reducing noise (hereinafter referred to as "engine muffled sound" or "engine noise") caused by a vibratory noise, which is produced by a vibratory noise source such as an engine or the like on a vehicle and generated periodically in synchronism with the rotation of the engine, by generating a control signal via a control unit, for canceling the engine noise based on a signal that is highly correlated to the vibratory noise produced by the vibratory noise source, and outputting a canceling sound, which is opposite in phase to the engine noise based on the control signal, into the passenger compartment of the vehicle (see Japanese Laid-Open Patent Publication No. 2004-361721).

While the vehicle is running, vibrations of the tires caused by the road are transmitted through suspensions to the vehicle body, thereby producing an aperiodic drumming noise (road noise) in the passenger compartment. The road noise constitutes a non-periodically generated low-frequency noise generated in the passenger compartment, and is produced as a resonant sound having a high sound pressure level at a certain frequency (resonant frequency), due to the resonant characteristics of the passenger compartment. Therefore, the resonant sound is defined by the road noise having a central frequency equal to a certain resonant frequency f of 40 [Hz], for example.

Japanese Laid-Open Patent Publication No. 2000-322066 discloses an active noise control apparatus (hereinafter also referred to as an "aperiodic-noise-compatible ANC") including a plurality of microphones installed in a passenger compartment. The microphones generate canceling error signals based on differences (hereinafter also referred to as "canceling error sounds") between the noise in the passenger compartment and a canceling sound, and output the generated canceling error signals to a control unit. The control unit generates a control signal based on the canceling error signals, and a speaker outputs a canceling sound based on the control signal into the passenger compartment. In this manner, road noise is reduced by the canceling sound according to a feedforward control process. Japanese Laid-Open Patent Publication No. 2000-322066 also reveals that microphones are used to detect noise in the passenger compartment, a control unit, which is in the form of an analog circuit, generates a control signal based on the noise, and that a speaker outputs canceling sounds based on the control signal into the passenger compartment. In this manner, road noise is reduced by canceling sounds according to a feedback control process.

Japanese Laid-Open Patent Publication No. 2001-282255 discloses that a speaker is shared by a periodic-noise-compatible ANC and/or an aperiodic-noise-compatible ANC (hereinafter also referred to simply as an "ANC") and an audio system on a vehicle, so that the speaker can output sounds based on an output signal from the audio system, and a canceling sound based on a control signal from the ANC, into the passenger compartment of the vehicle.

Engine noise referred to above is defined as periodically generated noise within a narrow frequency band having a predetermined central frequency. A periodic-noise-compatible ANC generates a control signal having a control frequency depending on the predetermined central frequency, and the speaker outputs canceling sounds having the control frequency into the passenger compartment for effectively reducing noise in the passenger compartment.

Road noise is defined as aperiodically generated low-frequency noise having a central frequency equal to a resonant frequency of 40 [Hz], for example, which is determined from the resonant characteristics of the passenger compartment. An aperiodic-noise-compatible ANC is required to reduce resonant sounds at respective resonant frequencies.

If the aperiodic-noise-compatible ANC generates a control signal according to a feedforward control process, then the control unit needs to comprise a FIR adaptive filter and a DSP (Digital Signal Processor) for performing convolutional calculations at the respective resonant frequencies. As a result, the aperiodic-noise-compatible ANC is relatively expensive to manufacture. Furthermore, since the aperiodic-noise-compatible ANC generates a control signal at the resonant frequencies, while updating the filter coefficient of the adaptive filter from time to time, the control unit suffers from an increased computational burden in connection with generating the control signal.

If the aperiodic-noise-compatible ANC generates a control signal according to a feedback control process, then the control unit needs to comprise a combination of several analog filters for generating a control signal at the resonant frequencies. As a result, the control unit requires a large circuit scale, thereby causing the ANC including the control unit to have a large unit size. However, it is difficult for an ANC having such a large unit size to find sufficient installation space inside the vehicle. In addition, it is also difficult to combine the ANC having such a large unit size with a digital audio unit.

An aperiodic-noise-compatible ANC has been considered for generating a control signal according to a feedback control process based on a digital signal processing method, to thereby silence an aperiodic resonant sound (resonant noise).

FIG. 18 of the accompanying drawings shows an aperiodic-noise-compatible ANC 200 comprising a microphone (canceling error signal detector) 18 and a speaker (sound output device) 22, which are disposed in the passenger compartment 14 of a vehicle, and a control unit 50. The control unit 50 comprises an A/D converter (ADC) 59, a controller 202 in the form of a microcomputer and having a given transfer function H, and a D/A converter (DAC) 65. The aperiodic noise includes a resonant sound (aperiodic resonant noise), which is aperiodically generated inside the passenger compartment 14, and which has a high sound pressure level at a certain resonant frequency f due to the configuration of the passenger compartment 14.

It is assumed that, at a time t(n−1) of a sampling event (n−1), the controller 202 generates a control signal y(n−1) in the form of a digital signal for canceling out noise (aperiodic noise) in the passenger compartment 14. Then, the DAC 65 converts the control signal y(n−1) into an analog signal, and the speaker 22 outputs a canceling sound into the passenger compartment 14 for canceling out the noise, based on the analog control signal y(n−1).

The microphone 18 is located at an antinode of the acoustic mode of the passenger compartment 14. At a time t(n) of a sampling event n, the microphone 18 outputs a canceling error signal e(n) to the ADC 59, representing a difference (canceling error sound) between the canceling sound and the noise.

Specifically, at the sampling event n, a canceling sound at the position of the microphone 18 is defined as a canceling sound that has been output from the speaker 22, based on the control signal y(n−1) from the controller 202 at the preceding sampling event (n−1), and that has reached the microphone 18. If the transfer characteristics from the speaker 22 to the microphone 18 with respect to the sound at the resonant frequency f are represented by C, then the canceling sound (the signal depending thereon) at the position of the microphone 18 at the sampling event n is represented by C·y(n−1). The transfer characteristics C are divided into gain characteristics (amplitude change) G' and a phase delay (phase characteristics) ϕ'. At the sampling event n, the resonant noise (the signal depending thereon) having a resonant frequency f at the position of the microphone 18 is represented by d(n).

Therefore, the canceling error signal e(n) output from the microphone 18 to the ADC 59 is expressed according to the following equation (1):

$$e(n)=d(n)+C\cdot y(n-1) \tag{1}$$

The ADC 59 converts the canceling error signal e(n) from an analog signal into a digital signal, and outputs the digital canceling error signal e(n) as an input signal x(n) to the controller 202. Based on the input signal x(n) {=e(n)}, the controller 202 generates a control signal y(n) {=−d(n+1)/C} depending on the canceling sound C·y(n), which is opposite in phase with a resonant noise d(n+1) at the position of the microphone 18.

According to the silencing control process carried out by the ANC 200 to silence the resonant noise, it is important to decide how to generate the control signal y(n) for the canceling sound C·y(n), which is opposite in phase with the resonant noise d(n+1) at the position of the microphone 18.

If it is assumed that the control signal n(y−1) is generated at the preceding sampling event (n−1) and the resonant noise d(n) at the position of the microphone 18 happens to be completely silenced by the canceling sound C·y(n−1) at the present sampling event n, then since the canceling error signal e(n) output from the microphone 18 is expressed by e(n)=d(n)+C·y(n−1)=0, the signal x(n) input to the controller 202 is expressed by x(n)=e(n)=0.

Since x(n)=0 regardless of the resonant noise d(n) present at the sampling event n, the controller 202 is unable to generate a control signal y(n) and the speaker 22 is unable to output a canceling sound. Therefore, the resonant noise d(n+1) at the position of the microphone 18 cannot be silenced. Alternatively, the controller 202 fails to generate a highly accurate control signal y(n), and even if the speaker 22 outputs a canceling sound, the resonant noise d(n+1) at the position of the microphone 18 cannot be silenced completely and the resonant noise d(n+1) remains unsilenced. As a result, the resonant noise d(n+1) cannot be silenced stably at the next sampling event (n+1).

SUMMARY OF THE INVENTION

It is an object of the present invention to provide an active noise control apparatus, which is capable of generating a control signal according to a simple digital signal processing method, benefits from a reduced computational burden in generating the control signal, and is relatively inexpensive to manufacture.

Another object of the present invention is to provide an active noise control apparatus, which is capable of stably silencing road noise in order to reliably reduce the road noise.

For easier understanding of the present invention, various elements and items shall be described below in combination with reference numerals and characters used in the accompanying drawings. However, such elements and items should not be interpreted as being limited to the components, signals, and other properties that are accompanied by these reference numerals and characters.

An active noise control apparatus (ANC) 204 according to the present invention basically comprises a control unit 50 for generating a control signal y(n), y(n−1) for canceling out noise in a passenger compartment 14 of a vehicle 12, a sound output device 22 for outputting a canceling sound for canceling out the noise based on the control signal y(n), y(n−1) into the passenger compartment 14, and a canceling error signal detector 18 for outputting a canceling error signal e(n) representing a canceling error sound between the noise and the canceling sound to the control unit 50.

According to a first aspect of the ANC 204, as shown in FIGS. 1 through 5, the control unit 50 comprises an A/D converter 59 for converting the canceling error signal e(n) from an analog signal into a digital signal, an echo canceler 58 for correcting the control signal y(n−1) and thereby generating a digital echo canceling signal $\hat{C}\cdot y(n-1)$ based on a corrective value $\hat{C}$ corresponding to (identifying) transfer characteristics between the sound output device 22 and the canceling error signal detector 18, a subtractor 60 for generating a first basic signal x(n) by subtracting the digital canceling error signal $\hat{C}\cdot y(n-1)$ from the digital echo canceling signal e(n), a delay filter 54 for generating a second basic signal x'(n) by delaying the first basic signal x(n) by a time $Z^{-n}$ corresponding to a ¼ period of a resonant frequency f determined by resonant characteristics of the passenger compartment 14, a first filter 62 for correcting the first basic signal x(n) and thereby generating a first corrective signal A·x(n), a second filter 64 for correcting the second basic signal x'(n) and thereby generating a second corrective signal B·x'(n), an adder 56 for generating the control signal y(n) by combining the first corrective signal A·x(n) and the second corrective signal B·x'(n), and a D/A converter 65 for converting the control signal y(n) from a digital signal into an analog signal and outputting the analog control signal to the sound output device 22.

The resonant frequency f of a resonant sound, such as road noise, is a known frequency determined by the structure of the passenger compartment. It is desirable for the ANC 204 to be able to reduce the resonant sound (first noise) at the known resonant frequency f. The control unit 50 generates the control signal y(n), which has a control frequency equal to the resonant frequency f and which is in opposite phase with the resonant sound. The sound output device 22 outputs the canceling sound based on the control signal y(n).

According to the first aspect, the control unit 50 has the echo canceler 58, which stores the corrective value $\hat{C}$ identifying the transfer characteristics C from the sound output device 22 to the canceling error signal detector 18, with respect to the sound at the control frequency f. The subtractor 60 subtracts the digital echo canceling signal $\hat{C}\cdot y(n-1)$ produced by correcting the control signal y(n−1) with the corrective value $\hat{C}$ from the canceling error signal e(n) output from the canceling error signal detector 18, thereby estimating a noise d(n) to be silenced at the position of the canceling error signal detector 18. The estimated noise d(n) is represented by the first basic signal x(n) that is supplied to a controller 202.

In the ANC 204, the first basic signal x(n) is expressed according to the following equation (2):

$$x(n)=e(n)-\hat{C}\cdot y(n-1)\approx d(n) \quad (2)$$

The corrective value $\hat{C}$ corresponding to (identifying) the transfer characteristics C represents signal transfer characteristics from an output terminal of the D/A converter 65 to an output terminal of the A/D converter 59, including the transfer characteristics C from the sound output device 22 to the canceling error signal detector 18.

The signal transfer characteristics are actually measured as follows: As shown in FIG. 2, a signal transfer characteristics measuring device 300, which comprises a Fourier transforming device, is connected between the input and output terminals of the controller 202. The signal transfer characteristics measuring device 300 measures signal transfer characteristics based on a test signal input from the controller 202 to the D/A converter 65 and a signal output from the subtractor 60 to the controller 202. The signal transfer characteristics measured by the signal transfer characteristics measuring device 300 are set as the corrective value $\hat{C}$ in the echo canceler 58. Depending on how the signal transfer characteristics measuring device 300 measures the signal transfer characteristics, the corrective value $\hat{C}$ may represent signal transfer characteristics from the sound output device 22 to the canceling error signal detector 18, or signal transfer characteristics from the output to input terminals of the controller 202, including the signal transfer characteristics from the sound output device 22 to the canceling error signal detector 18.

The corrective value (transfer characteristics) $\hat{C}$ including the transfer characteristics C is identified according to the above measuring process. As with the transfer characteristics C, the transfer characteristics $\hat{C}$ are also divided into gain characteristics (amplitude change) G and a phase delay (phase characteristics) $\phi$.

In the controller 202, the delay filter 54 generates the second basic signal x'(n) by delaying the first basic signal x(n) a predetermined time $Z^{-n}$ based on the control frequency f, and the adder 56 combines a first corrective signal A·x(n) produced by correcting the first basic signal x(n) and a second corrective signal B·x'(n) produced by correcting the second basic signal x'(n), resulting in the control signal y(n).

Since the controller 202 generates the control signal y(n) $\{=-d(n+1)/\hat{C}\}$, for canceling out the noise d(n+1) to be silenced at the position of the canceling error signal detector 18, from the first basic signal x(n) and the second basic signal x'(n) and based on the noise d(n) estimated by the subtractor 60, the canceling sound for canceling out the noise can simply and accurately be generated without the need for a FIR adaptive filter. Thus, the ANC 204 has a simpler arrangement and can be manufactured less expensively.

Since the first basic signal x(n) is used to represent the noise d(n) that is determined by subtracting the echo canceling signal $\hat{C}\cdot y(n-1)$ from the canceling error signal e(n), the control signal y(n) can be generated as long as the noise d(n) is present, so that the noise d(n+1) at the position of the microphone 18 can stably be silenced.

If it is assumed that the noise d(n) is not estimated using the canceling signal $\hat{C}\cdot y(n-1)$, but the canceling error signal e(n) is directly used as the first basic signal x(n) (see FIG. 18), and a noise d(i) at the position of the canceling error signal detector 18 happens to be completely silenced at a certain instant (sampling event: n=1), then since e(i)=x(i)=0, the controller 202 is unable to generate a control signal y(n) {y(i)=0}, regardless of the noise d(i) being present in the passenger compartment 14, and the speaker 22 is unable to output any canceling sounds. Therefore, the noise d(n+1) at the position of the canceling error signal detector 18 cannot be silenced in the next sampling event (n=i+1). Alternatively, the controller 202 fails to generate a highly accurate control signal y(i), and even if the speaker 22 outputs a canceling sound, the noise d(n+1) at the position of the canceling error signal detector 18 cannot be silenced completely, but rather remains unsilenced. As a result, the noise d(n+1) cannot stably be silenced.

The predetermined time $Z^{-n}$ corresponds to $\pi/2$ (90°}, and the first basic signal x(n) and the second basic signal x'(n) are orthogonal to each other on a Gaussian plane, as shown in FIG. 3C.

According to a second aspect of the ANC 204, the control unit 50 comprises an A/D converter 59 for converting the canceling error signal e(n) from an analog signal into a digital signal, an echo canceler 58 for correcting the control signal y(n−1) and thereby generating a digital echo canceling signal $\hat{C}\cdot y(n-1)$ based on transfer characteristics (a corrective value $\hat{C}$ identifying such transfer characteristics) between the sound output device 22 and the canceling error signal detector 18, a subtractor 60 for generating a first basic signal x(n) by subtracting the digital canceling error signal $\hat{C}\cdot y(n-1)$ from the digital echo canceling signal e(n), a delay filter 55 for generating a second basic signal x"(n) by delaying the first basic signal x(n) by a predetermined time $Z^{-m}$ based on a resonant frequency f determined by resonant characteristics of the passenger compartment 14, an adder 56 for combining the first basic signal x(n) and the second basic signal x"(n) into a combined signal {x(n)+x"(n)}, an amplitude adjuster 70 for adjusting the amplitude of the combined signal {x(n)+x"(n)} with a predetermined gain P to a predetermined magnitude thereby generating the control signal y(n), and a D/A converter 65 for converting the control signal y(n) from a digital signal into an analog signal and outputting the analog control signal to the sound output device 22.

The first aspect is different from the second aspect as to the predetermined time $Z^{-m}$ by which the first basic signal x(n) is delayed. As with the transfer characteristics $\hat{C}$ in the first aspect, the transfer characteristics (the corrective value) $\hat{C}$ is divided into gain characteristics (amplitude change) G and a phase delay (phase characteristics) $\phi$.

Specifically, the predetermined time $Z^{-m}$ has a value based on the control frequency f and phase characteristics (phase delay $\phi$) of the transfer characteristics $\hat{C}$ with respect to the sound at the control frequency f. Specifically, the predetermined time $Z^{-m}$ is a time corresponding to a phase value $2\Psi$ that is twice the value produced by subtracting the phase characteristics (phase delay) $\phi$ from the phase difference between the first basic signal x(n) and the canceling sound $\hat{C}\cdot y(n)$, which is opposite in phase with the noise d(n).

The predetermined time $Z^{-m}$ actually is determined on a trial and error basis, based on the gain P of the amplitude adjuster 70 and a phase value $\Psi$, at the time a test noise d(n) having the control frequency f is generated in the passenger compartment 14 and the generated test noise is silenced at the position of the canceling error signal detector 18.

According to the first and second aspects, since the control signal y(n) is simply and accurately generated without the need for a conventional FIR adaptive filter, and is output as a canceling sound from the sound output device 22 into the passenger compartment 14, drumming noises including road noises in the passenger compartment 14 can reliably be reduced.

Particularly, according to the first aspect, inasmuch as the second basic signal x'(n) is generated by delaying the first basic signal x(n) by a time $Z^{-n}$ corresponding to a ¼ period of the resonant frequency (control frequency) f, that is, by shifting the phase of the first basic signal x(n) by 90°, the control signal y(n) {=−d(n+1)/Ĉ} for canceling out the noise d(n+1) to be silenced at the position of the canceling error signal detector 18 can simply and accurately be generated from the first basic signal x(n) and the second basic signal x'(n). Thus, the ANC 204 has a simpler arrangement and can be manufactured less expensively.

Since the control unit 50 can generate the control signal y(n) through a simpler digital signal processing method, the computational burden for generating the control signal y(n) is reduced. Further, since the control unit 50 may be of a simple arrangement using a microcomputer 52, which is relatively inexpensive, the ANC 204 can be manufactured inexpensively. As a result, the ANC 204 can be reduced in overall size, and the ANC 204 be combined with a digital audio unit in the vehicle 12.

According to the first aspect, the echo canceler 58 preferably comprises a first cosine corrector 80 for correcting the first basic signal x(n) with a cosine value Cr of phase characteristics (phase delay ϕ) of the transfer characteristics Ĉ and outputting a corrected signal, a first sine corrector 82 for correcting the second basic signal x'(n) with a sine value Ci of the phase characteristics and outputting a corrected signal, a subtractor 88 for subtracting the corrected signal output from the first sine corrector 82 from the corrected signal output from the first cosine corrector 80 thereby to generate a differential signal Sm, a second cosine corrector 84 for correcting the second basic signal x'(n) with the cosine value Cr and outputting a corrected signal, a second sine corrector 86 for correcting the first basic signal x(n) with the sine value Ci and outputting a corrected signal, a first adder 90 for adding the corrected signal output from the second cosine corrector 84 and the corrected signal output from the second sine corrector 86 into a sum signal Sp, a first correcting filter 92 for correcting the differential signal Sm and outputting a corrected signal, a second correcting filter 94 for correcting the sum signal Sp and outputting a corrected signal, and a second adder 96 for adding the corrected signal from the first correcting filter 92 and the corrected signal from the second correcting filter 94 together with the echo canceling signal Ĉ·y(n−1), and outputting the echo canceling signal Ĉ·y(n−1) to the subtractor 60.

The processing sequence for generating the echo canceling signal Ĉ·y(n−1) in the echo canceler 58 comprises a total of nine processes including arithmetic operations, i.e., four correcting processes carried out respectively by the first cosine corrector 80, the second cosine corrector 84, the first sine corrector 82, and the second sine corrector 86, one subtracting process carried out by the subtractor 88, one adding process carried out by the first adder 90, two correcting processes carried out respectively by the first correcting filter 92 and the second correcting filter 94, and one adding process carried out by the second adder 96. As a result, the amount of processing operations required for generating the echo canceling signal is reduced. In other words, the echo canceling signals Ĉ·y(n−1), Ĉ·y(n) can be generated by a simple arrangement, without the need for a FIR filter.

Each of the first filter 62, the second filter 64, the first correcting filter 92, and the second correcting filter 94 should preferably comprise an adaptive filter. The control unit 50 should preferably further comprise a first filter coefficient updater 100 for updating respective filter coefficients A of the first filter 62 and the first correcting filter 92 in order to minimize the canceling error signal e(n) based on the canceling error signal e(n) and the differential signal Sm, a second filter coefficient updater 102 for updating respective filter coefficients B of the second filter 64 and the second correcting filter 94 in order to minimize the canceling error signal e(n) based on the canceling error signal e(n) and the sum signal Sp.

Accordingly, even if the transfer characteristics C, Ĉ vary due to mass-production-induced variations in the layout of the sound output device 22 and the canceling error signal detector 18 in the passenger compartment 14, or change due to aging or the like, since the filter coefficients A of the first filter 62 and the first correcting filter 92 and the filter coefficients B of the second filter 64 and the second correcting filter 94 are updated under an adaptive control, noise inside the passenger compartment 14 can accurately be silenced.

If each of the first filter 62, the second filter 64, the first correcting filter 92, and the second correcting filter 94 comprises an adaptive notch filter, then road noise at a frequency f can reliably be silenced.

The control unit (50) preferably further comprises a delay filter D/A converter 75 and a delay filter A/D converter 77. The delay filter 74 preferably comprises an allpass filter for equalizing the phase delay at the control frequency f to a phase delay corresponding to a ¼ period of the control frequency f. The delay filter D/A converter 75 preferably should convert the first basic signal x(n) from a digital signal into an analog signal, for outputting the analog first basic signal x(n) to the delay filter 74. The delay filter A/D converter 77 preferably should convert the second basic signal x'(n) from an analog signal into a digital signal, for outputting the digital second basic signal x'(n) to the second filter 64.

Thus, the delay filter 74 may be in the form of an analog circuit. If the control unit 50 is implemented by a microcomputer, the delay filter 74 needn't be included in the microcomputer, and hence the microcomputer may be of a simpler arrangement.

The ANC 204 preferably comprises an antialiasing filter 66 for passing only a signal having a predetermined frequency or lower, and outputting the signal to the control unit 50. The predetermined frequency preferably should be higher than a control frequency of the control signal.

If the control unit 50 includes a microcomputer for generating the control signal y(n) according to a digital signal processing method, then the antialiasing filter 66 removes a folding noise having a predetermined frequency or higher from the canceling error signal e(n), and then supplies the canceling error signal e(n) to the microcomputer. Accordingly, the control signal y(n) can be generated accurately in the microcomputer.

The ANC 204 preferably further comprises a reconstruction filter 68 for removing a high-frequency component from the control signal y(n) output from the control unit 50 and for outputting the control signal y(n) from which the high-frequency component has been removed to the sound output device 22. The high-frequency component preferably has a frequency higher than the control frequency f.

If the control unit 50 includes a microcomputer for generating the control signal y(n) according to a digital signal processing method, and the control signal y(n) is converted into an analog signal that is output to the sound output device 22, then the reconstruction filter 68 removes a high-frequency component from the analog control signal y(n), so that the analog control signal y(n) exhibits a smooth waveform over time. As a result, the sound output device 22 can output a canceling sound of high quality, based on the control signal y(n) from which the high-frequency component has been removed.

The ANC 204 preferably further comprises a bandpass filter 72 for passing and outputting to the control unit 50, from within the canceling error signal e(n), only a signal in a predetermined frequency band and having a central frequency equal to the control frequency f.

If the control unit 50 includes a microcomputer for generating the control signal y(n) according to a digital signal processing method, then the bandpass filter 72 passes only a signal having a predetermined frequency band of the canceling error signal e(n), and the signal that has passed through the bandpass filter 72 is supplied to the microcomputer. Accordingly, the control signal y(n) can be generated accurately in the microcomputer.

The above and other objects, features, and advantages of the present invention will become more apparent from the following description when taken in conjunction with the accompanying drawings, in which preferred embodiments of the present invention are shown by way of illustrative example.

BRIEF DESCRIPTION OF THE DRAWINGS

FIG. 5 is a diagram illustrating the generation of a second basic signal in the case that a delay filter shown in FIG. 1 comprises registers;

DESCRIPTION OF THE PREFERRED EMBODIMENTS

Figure 1:
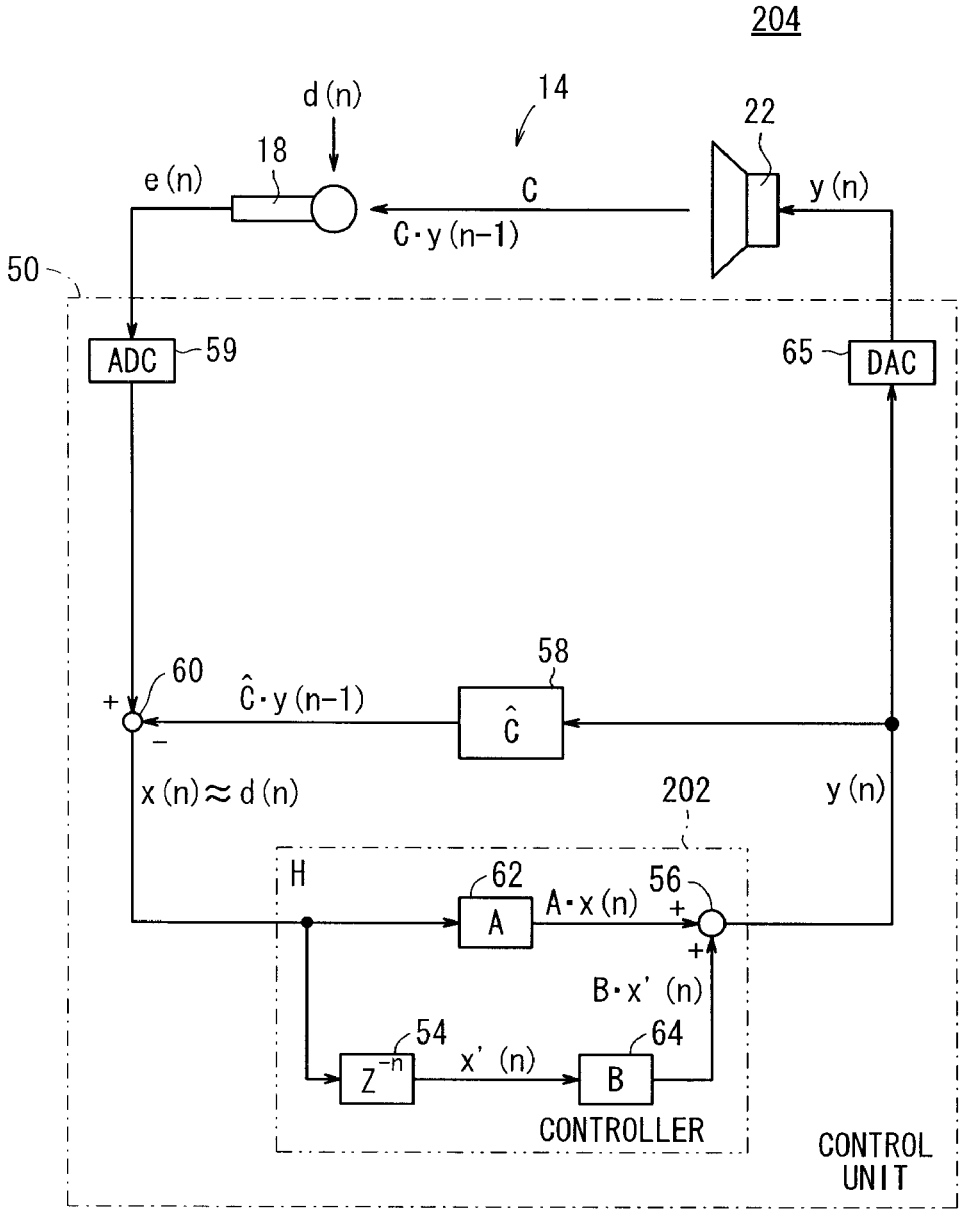
FIG. 1 is a schematic block diagram of an ANC, which is illustrative of a first fundamental concept of the present invention.

Like or corresponding parts are denoted by like or corresponding reference characters throughout the views.

Active noise control apparatuses according to preferred embodiments of the present invention shall be described below with reference to the drawings. Prior to describing the specific details of such active noise control apparatuses (hereinafter also referred to as "ANCs") according to preferred embodiments of the present invention, fundamental concepts (first and second concepts) thereof will be described below with reference to FIGS. 1 through 7.

Figure 18:
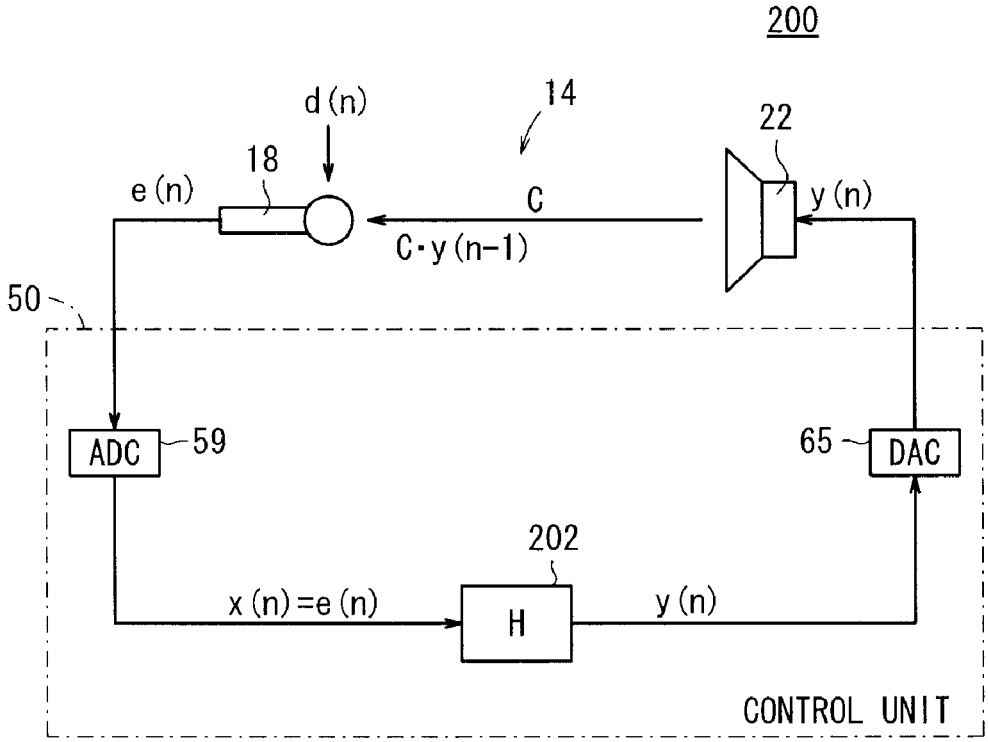
FIG. 18 is a schematic block diagram of an arrangement of an aperiodic-noise-compatible ANC, according to the related art.

With respect to the first and second concepts, parts thereof which are identical to those of the ANC 200 (see FIG. 18) according to the related art shall be denoted by identical reference characters.

FIG. 1 is a schematic block diagram of an ANC 204, to which a first fundamental concept of the present invention is applied.

As shown in FIG. 1, the ANC 204 is an aperiodic-noise-compatible ANC based on a feedforward control process. The ANC 204 comprises a microphone (canceling error signal detector) 18 and a speaker (sound output device) 22 which are disposed in a passenger compartment 14 of a vehicle, and a control unit 50. The control unit 50 comprises an ADC (A/D converter) 59, an echo canceler 58, a subtractor 60, a controller 202, and a DAC (D/A converter) 65. FIG. 1 illustrates operation of the ANC 204 in a sampling event n at a given time t(n). Similarly, operation of the ANCs shown in other block diagrams will also be described as occurring in a sampling event n at a given time t(n).

The controller 202 includes a transfer function H, and comprises a first filter 62 having a filter coefficient (gain) A, a second filter 64 having a filter coefficient (gain) B, a delay filter 54, and an adder 56.

It is assumed that at time t(n−1) of a sampling event (n−1), the controller 202 generates a control signal y(n−1) in the form of a digital signal for canceling out noise in the passenger compartment 14. The DAC 65 converts the control signal y(n−1) into an analog signal, and the speaker 22 outputs a canceling sound into the passenger compartment 14 for canceling out noise based on the analog third control signal y(n−1).

The microphone 18 is located at an antinode of the acoustic mode of the passenger compartment 14. At a given sampling event n, the microphone 18 outputs a canceling error signal e(n), representing the difference (canceling error sound) between the canceling sound and the noise to the ADC 59. The noise includes a resonant sound (aperiodic resonant noise), which is aperiodically generated in the passenger compartment 14 and has a high sound pressure level at a certain resonant frequency f, due to the configuration of the passenger compartment 14.

The ADC 59 converts the canceling error signal e(n) from an analog signal into a digital signal, and outputs the digital canceling error signal e(n) to the subtractor 60. The echo canceler 58 generates an echo canceling signal $\hat{C}\cdot y(n-1)$ by correcting the control signal y(n−1) with a corrective value $\hat{C}$, which is representative of transfer characteristics C from the speaker 22 to the microphone 18 with respect to the sound of a control frequency f. Then, the echo canceler 58 outputs the generated echo canceling signal $\hat{C}\cdot y(n-1)$ to the subtractor 60. The echo canceling signal $\hat{C}\cdot y(n-1)$ is a signal that depends on the canceling sound output from the speaker 22 and which reaches the microphone 18.

The corrective value $\hat{C}$ represents signal transfer characteristics from an input terminal of the DAC 65 to an output terminal of the ADC 59, including the transfer characteristics C from the speaker 22 to the microphone 18.

Figure 2:
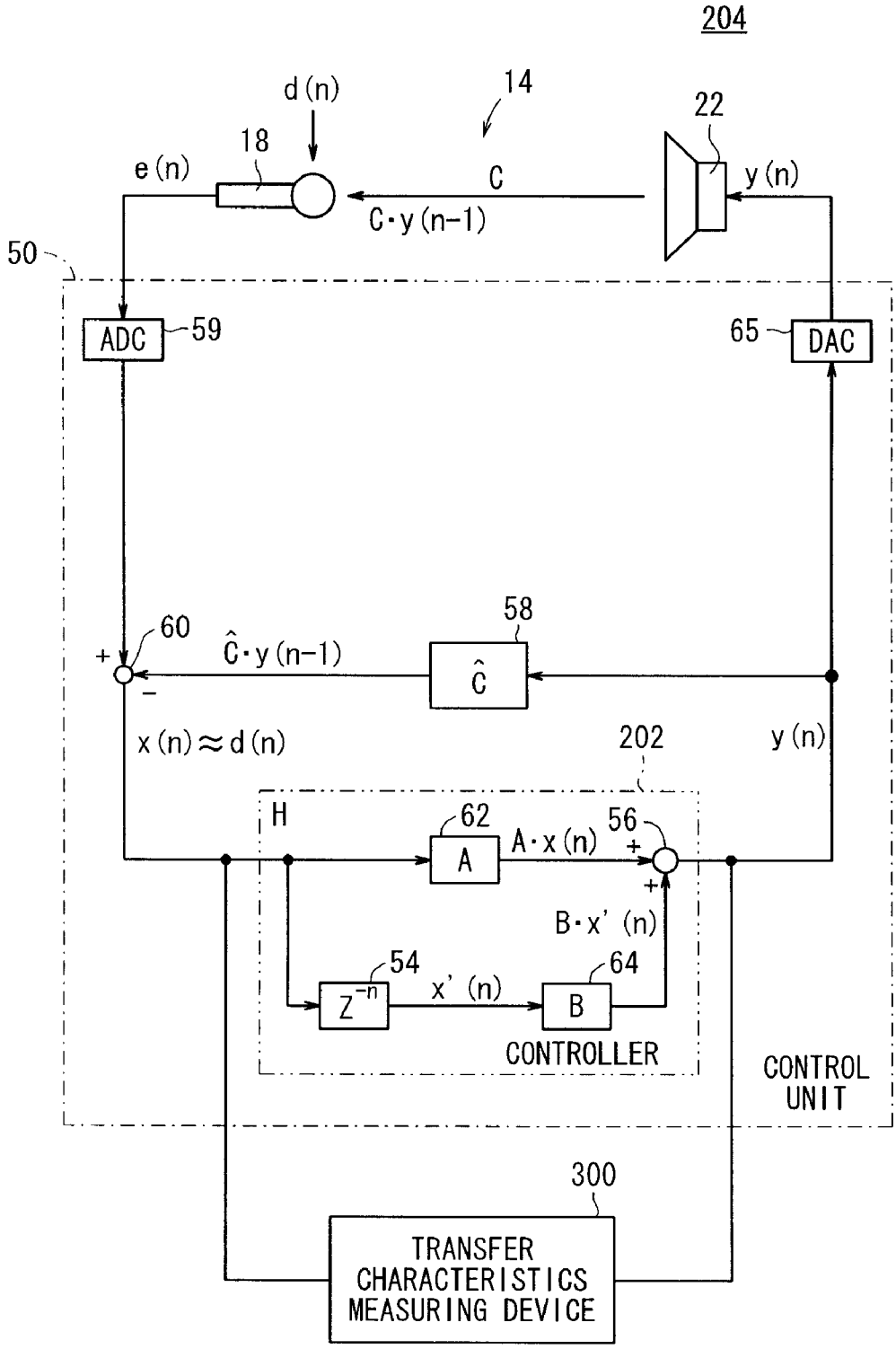
FIG. 2 is a schematic block diagram illustrating measurement of signal transfer characteristics by a signal transfer characteristics measuring device in the ANC shown in FIG. 1.

The signal transfer characteristics actually are measured as follows: As shown in FIG. 2, a signal transfer characteristics measuring device 300, which comprises a Fourier transforming device, is connected between the input and output terminals of the controller 202. The signal transfer characteristics measuring device 300 measures signal transfer characteristics based on a test signal, which is input from the controller 202 to the DAC 65, and a signal output from the subtractor 60 to the controller 202. In FIGS. 1 and 2, the signal transfer characteristics measured by the signal transfer characteristics measuring device 300 are set as the corrective value $\hat{C}$ in the echo canceler 58. Depending on how the signal transfer characteristics measuring device 300 measures the signal transfer characteristics, the corrective value $\hat{C}$ may represent signal transfer characteristics from the speaker 22 to the microphone 18, or alternatively, signal transfer characteristics from the output terminal to the input terminal of the controller 202, including signal transfer characteristics from the speaker 22 to the microphone 18, which are measured as described above.

The corrective value (transfer characteristics) $\hat{C}$ including the transfer characteristics C is identified according to the aforementioned measuring process. As described above, the transfer characteristics C are divided into gain characteristics (amplitude change) G' and a phase delay (phase characteristics) $\phi'$. The corrective value $\hat{C}$ is divided into gain characteristics (amplitude change) G and a phase delay (phase characteristics) $\phi$.

The subtractor 60 subtracts the echo canceling signal $\hat{C}\cdot y(n-1)$, dependent on the canceling sound from the canceling error signal e(n), which in turn depends on the canceling error signal, thereby estimating a resonant noise d(n) at the position of the microphone 18. Then, the subtractor 60 outputs a first basic signal x(n) based on the resonant noise d(n) to the controller 202. Based on the input first basic signal x(n), the controller 202 generates a control signal y(n) depending on a canceling sound $\hat{C}\cdot y(n)$, which is opposite in phase with and has the same amplitude as the resonant noise d(n+1) to be silenced, in a next sampling event (n+1) at the position of the microphone 18.

The first fundamental concept will be described in more specific detail with reference to FIG. 1 and FIGS. 3A through 3C, showing vectors on a Gaussian plane.

In the sampling event n, the canceling sound that reaches the microphone 18 is expressed by $\hat{C}\cdot y(n-1)$. Therefore, the canceling error signal e(n) output from the microphone 18 is expressed according to the following equation (3):

$$e(n)=d(n)+\hat{C}\cdot y(n-1) \tag{3}$$

The ADC 59 converts the canceling error signal e(n) from an analog signal into a digital signal, and outputs the digital canceling error signal e(n) to the subtractor 60.

The echo canceler 58 generates an echo canceling signal $\hat{C}\cdot y(n-1)$ by correcting the control signal y(n−1) output from the controller 202 in the preceding sampling event (n−1) with the corrective value $\hat{C}$, and outputs the echo canceling signal $\hat{C}\cdot y(n-1)$ to the subtractor 60.

The subtractor 60 subtracts the echo canceling signal $\hat{C}\cdot y(n-1)$ from the canceling error signal e(n), thereby estimating the resonant noise d(n), and outputs a first basic signal x(n) based on the resonant noise d(n) to the controller 202.

In view of the equation (3), the first basic signal x(n) is expressed according to the following equation (4):

$$x(n)=e(n)-\hat{C}\cdot y(n-1)\approx d(n) \tag{4}$$

According to equation (4), the first basic signal x(n) corresponds to the resonant noise d(n) at the position of the microphone 18, which is determined based on the canceling error signal e(n) and the control signal y(n).

Generation of the control signal y(n) in the controller 202 shall be described below.

Figure 3A:
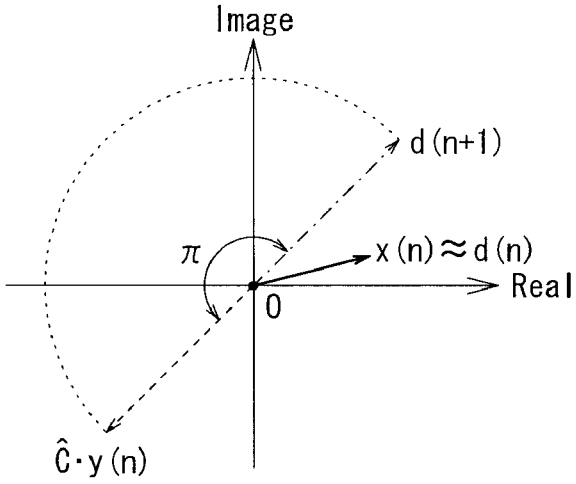
FIG. 3A is a diagram of vectors on a Gaussian plane, showing the relationship between $\hat{C}\cdot y(n)$ and d(n+1)

As shown in FIG. 3A, if the controller 303 can generate, in the sampling event n, a control signal y(n) (see FIG. 3B) depending on a canceling sound C·y(n) {=−d(n+1)}, which is opposite in phase with and has the same amplitude as the resonant noise d(n+1) to be silenced, in a next sampling event (n+1) at the position of the microphone 18, based on the first basic signal x(n) {≈d(n)} in the present sampling event n, then when the speaker 22 outputs canceling sounds based on the control signal y(n) into the passenger compartment 14, the resonant noise d(n+1) can reliably be silenced by the canceling sound $\hat{C}\cdot y(n)$.

In other words, as long as resonant noise d(n) is present, the control signal y(n) can be output, so that the resonant noise d(n+1) at the position of the microphone 18 can stably be silenced.

Figure 3B:
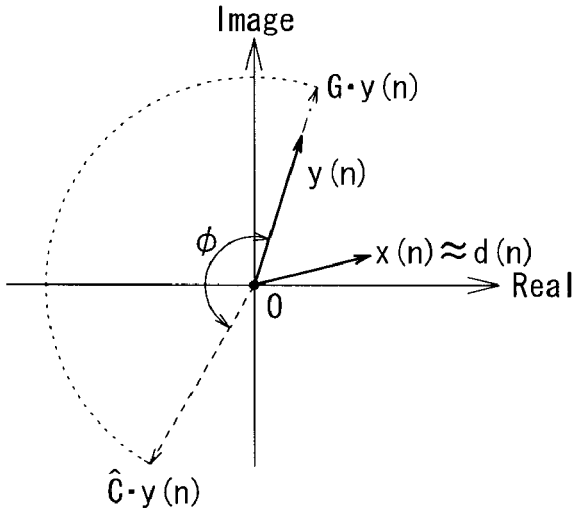
FIG. 3B is a diagram of vectors on a Gaussian plane, showing the relationship between $\hat{C}\cdot y(n)$ and G-y(n)

As described above, the transfer characteristics C from the speaker 22 to the microphone 18 are identified by the corrective value $\hat{C}$, and the corrective value $\hat{C}$ is divided into the gain characteristics G and the phase delay $\phi$. Therefore, as shown in FIG. 3B, the canceling sound $\hat{C}\cdot y(n)$ that reaches the microphone 18 is generated by multiplying the magnitude of the control signal y(n) by G, and rotating G·y(n) through the phase delay $\phi$. The controller 202 thus generates the control signal y(n) using the first basic signal x(n).

However, the control signal y(n) cannot be generated only from the first basic signal x(n) shown in FIGS. 3A and 3B.

Figure 3C:
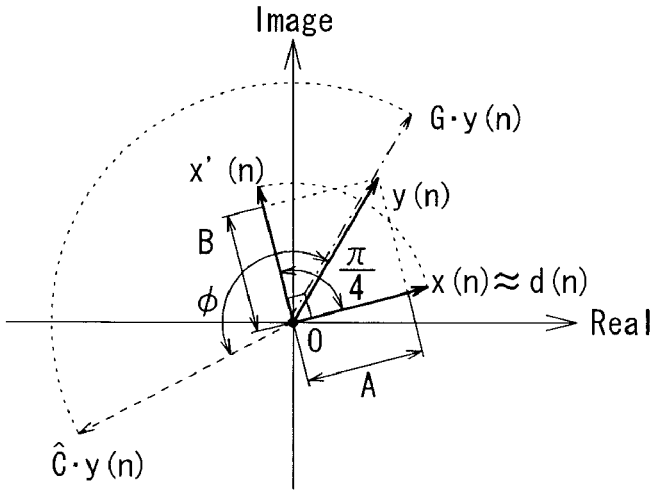
FIG. 3C is a diagram of vectors on a Gaussian plane, showing the generation of y(n) from x(n) and x'(n)

Consequently, as shown in FIG. 3C, a second basic signal x'(n), which is orthogonal to and has the same amplitude as the first basic signal x(n), is generated and the control signal y(n) is generated based on the first basic signal x(n) and the second basic signal x'(n). In this case, the control signal y(n) is represented by a combined vector of A·x(n), which is the product of the first basic signal x(n) and the filter coefficient (gain) A, and B·x'(n), which is the product of the second basic signal x'(n) and the filter coefficient (gain) B {y(n)=A·x(n)+B·x'(n)}.

Specifically, as shown in FIGS. 1 and 3C, the controller 202 regards the first basic signal x(n) as a cosine signal expressed according to the following equation (5):

$$x(n)=\cos\{2\pi f\times t(n)\}\approx d(n) \tag{5}$$

The delay filter 54 delays the first basic signal x(n) by a time $Z^{-n}$ (90°) corresponding to a ¼ period of the resonant frequency f determined by the resonant characteristics of the passenger compartment 14, thereby generating a cosine signal (second basic signal) x'(n) which is orthogonal to and has the same amplitude as the first basic signal x(n), as expressed according to the following equation (6):

$$x'(n) = \cos[2\pi f \times \{t(n) + \pi/2\}] = \sin\{2\pi f \times t(n)\} \quad (6)$$

The first filter 62 generates a first corrective signal A·x(n) by multiplying the first basic signal x(n) by the filter coefficient A, and outputs the generated first corrective signal A·x(n) to the adder 56. The adder 56 generates the control signal y(n) by combining the first corrective signal A·x(n) and the second corrective signal B·x'(n). The control signal y(n) is expressed according to the following equation (7):

$$y(n) = A \cdot x(n) + B \cdot x'(n) = A \cdot \cos\{2\pi f \cdot t(n)\} + B \cdot \sin\{2\pi f \cdot t(n)\} \quad (7)$$

When the DAC converts the control signal y(n) from a digital signal into an analog signal and the speaker 22 outputs a canceling sound based on the analog control signal y(n) into the passenger compartment 14, the resonant noise d(n+1) at the position of the microphone 18 is reduced by the canceling sound $\hat{C}$·y(n), which reaches the microphone 18 in the sampling event (n+1). As described above, the canceling sound $\hat{C}$·y(n) is opposite in phase with the resonant noise d(n+1), and the product G·y(n) is a signal component produced by removing the phase delay ϕ from the canceling sound $\hat{C}$·y(n).

According to the first fundamental concept, when the microphone 18 outputs the canceling error signal e(n), the control signal y(n) {=−d(n+1)/$\hat{C}$}, which serves to cancel out the resonant noise d(n+1) to be silenced at the position of the microphone 18, can be generated from the first basic signal x(n) and the second basic signal x'(n). Therefore, the canceling sound $\hat{C}$·y(n) can be generated simply and accurately without the need for a FIR adaptive filter. Hence, the ANC 204 is simpler in arrangement and less expensive to manufacture.

Since the first basic signal x(n) is used as representing the resonant sound d(n) that is determined by subtracting the echo canceling signal $\hat{C}$·y(n−1) from the canceling error signal e(n), the control signal y(n) can be generated as long as the resonant noise d(n) is present, so that the resonant noise d(n+1) at the position of the microphone 18 can be silenced stably.

Figure 4:
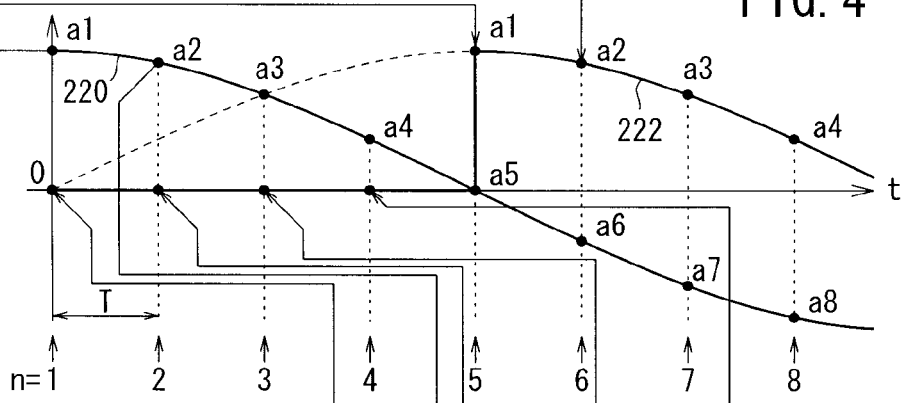
FIG. 4 is a diagram illustrating the generation of a second basic signal in the case that a delay filter shown in FIG. 1 comprises buffers.

FIGS. 4 and 5 illustrate a process of generating the second basic signal x'(n) with the delay filter 54. It is assumed that the control unit 50 has a sampling period T.

The delay time $Z^{-n}$, which corresponds to a ¼ period of the resonant frequency f as described above, is set to a value expressed as $Z^{-n}$>>T and $Z^{-n}$=m×T (m: an integer). For example, if the control frequency f=30 [Hz] and the sampling frequency (=1/T) is 3000 [Hz], then since $Z^{-n}$=(¼)×(1/30) [s]=1/120[s] and T=1/3000[s], m=$Z^{-n}$/T=3000/120=25. One period (1/30[s]) for the control frequency f corresponds to 100 sampling events, with respect to T=1/3000[s], and $Z^{-n}$=1/120[s] corresponds to 25 sampling events (a time depending on π/2).

In FIG. 4, the delay filter 54 (see FIG. 1) comprises N (N=m+1) buffers.

In FIG. 4, it shall be assumed for the sake of brevity that m=4, N=m+1=5, i.e., the delay time $Z^{-n}$ is four times the sampling period, and the delay filter 54 comprises five buffers. As described above, when the first basic signal x(n) is a cosine signal, the second basic signal x'(n) is a sine signal. Therefore, in FIG. 4, the first basic signal x(n) is represented by a cosine signal 220, and the second basic signal x'(n) is represented by a sine signal 222.

The delay filter 54 (see FIG. 1) successively stores instantaneous values an (n=1, 2, . . . , i, . . . ), which are output as the cosine signal 220 from the subtractor 60 in respective sampling events, in the respective buffers 0 through 4.

Since the delay time $Z^{-n}$=m·T=4T, the delay filter 54 reads a stored instantaneous value a(i−4) from a buffer, which stores the instantaneous value a(i−4) that is m sampling events (n=i−m) prior to the buffer storing an instantaneous value ai, and outputs the read instantaneous value a(i−4) as a second basic signal x'(n) in the sampling event i. For example, in the sampling event i=7, an instantaneous value a7 is stored in the buffer 1, and an instantaneous value a3, which is stored in the buffer 2 and which is four sampling events (n=3) prior to the buffer 1, is read and output as a second basic signal x'(7) in the sampling event i=7.

Therefore, if the first basic signal x(i) is represented by an instantaneous value ai output from the subtractor 60 at the timing of the sampling event i, then the second basic signal x'(n) is represented by an instantaneous value of a(i−4), which is delayed by a ¼ period from the first basic signal x(i).

The number of buffers is given as N=m+1 for storing instantaneous value data an corresponding to the delay time $Z^{-n}$, and also for storing the instantaneous value an, which is output from the subtractor 60 during the present sampling event n.

As shown in FIG. 4, since the number of buffers is one greater than m, the buffer storing the instantaneous value a(i−4), which is m sampling events (n=i−m) prior to the buffer storing the instantaneous value ai in the sampling event n=i, refers to a buffer that is updated during a next sampling event (i+1).

If the delay filter 54 comprises a shift register instead of buffers, then the shift register comprises N=m registers.

In this case, in the respective sampling events n, the delay filter 54 successively stores instantaneous values an in the respective registers, and reads the oldest instantaneous value (oldest data) an prior to being stored as a second basic signal x'(n). If the first basic signal x(i) is represented by the instantaneous value an output from the subtractor 60 at the timing of the sampling event i, then the second basic signal x'(n) is represented by a(i−4) and is delayed by a ¼ period from the first basic signal x(i).

According to the first fundamental concept, as described above, when the microphone 18 outputs the canceling error signal e(n), the control signal y(n) {=−d(n+1)/$\hat{C}$}, which acts to cancel out the resonant noise d(n+1) to be silenced at the position of the microphone 18, can be generated from the first basic signal x(n) and the second basic signal x'(n). Therefore, the canceling sound $\hat{C}$·y(n) can simply and accurately be generated, without the need for a FIR adaptive filter. Hence, the ANC 204 is simpler in arrangement and less expensive to manufacture.

Since the first basic signal x(n) is used to represent the resonant sound d(n) that is determined by subtracting the echo canceling signal $\hat{C}$·y(n−1) from the canceling error signal e(n), the control signal y(n) can be generated as long as the resonant noise d(n) is present, so that the resonant noise d(n+1) at the position of the microphone 18 can be silenced stably.

Figure 6:
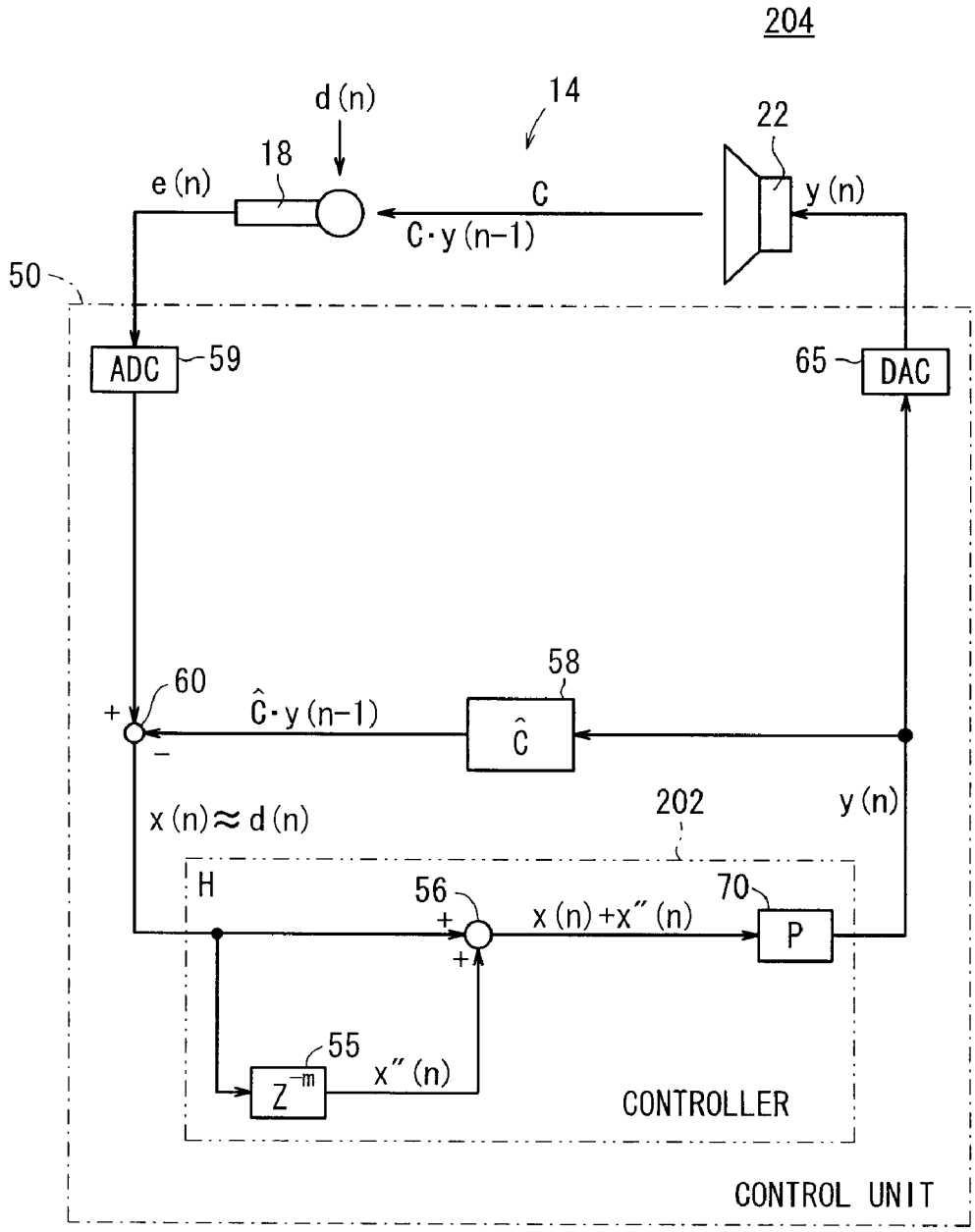
FIG. 6 is a schematic block diagram of an ANC, which is illustrative of a second fundamental concept of the present invention.

The second fundamental concept will be described below with reference to FIGS. 6 and 7. The second fundamental concept differs from the first fundamental concept (see FIGS. 1 through 5), in that a controller 202 comprises a delay filter 55, an adder 56, and a filter (amplitude adjuster) 70 having a predetermined filter coefficient (gain) P.

The second fundamental concept is similar to the first fundamental concept, in that the control signal y(n) depending on the canceling sound $\hat{C}\cdot y(n)$, which is in opposite phase with and has the same amplitude as the resonant noise d(n+1) to be silenced in the next sampling event (n+1) at the position of the microphone 18, is generated in the present sampling event n based on the first basic signal x(n) {≈d(n)} in the sampling event n. However, the second fundamental concept differs from the first fundamental concept as to how the control signal y(n) is generated in the controller 202. According to the second fundamental concept, the corrective value $\hat{C}$ is also divided into gain characteristics (amplitude change) G and a phase delay (phase characteristics) ϕ.

The delay filter 55 generates a second basic signal x"(n) expressed according to the following equation (8) by delaying the first basic signal x(n) expressed according to the above equation (5) by a predetermined time $Z^{-m}$ (thereby delaying the phase thereof by a predetermined angle 2Ψ):

$$x''(n)=\cos\,[2\pi f\times\{t(n)+2\Psi\}] \tag{8}$$

Figure 7:
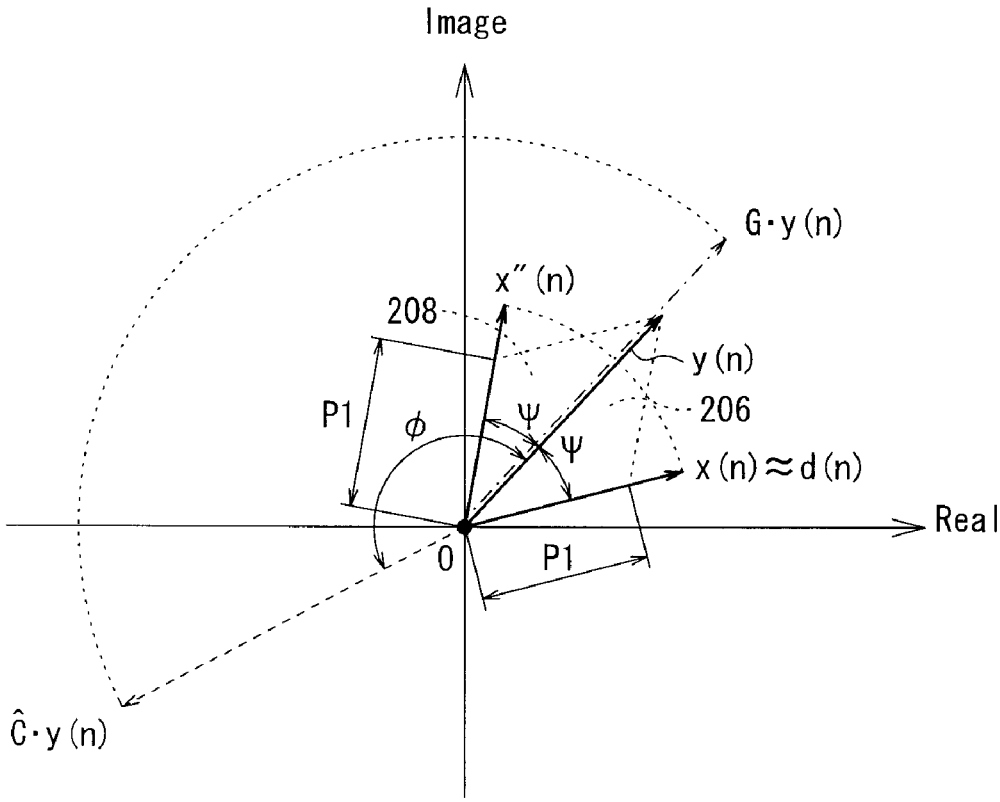
FIG. 7 is a diagram of vectors on a Gaussian plane, showing the generation of y(n) from x(n) and x"(n)

Therefore, as shown in FIG. 7, the second basic signal x"(n) is a signal that has the same amplitude as the first basic signal x(n) while being 2Ψ out of phase with the first basic signal x(n).

The predetermined time $Z^{-m}$ has a value based on the control frequency f, which is equal to the resonant frequency f of the resonant noise d(n), and a phase delay (phase characteristics) ϕ of the transfer characteristics (corrective value) $\hat{C}$ of the sound at the control frequency f. Specifically, the predetermined time $Z^{-m}$ is a time corresponding to the phase value 2Ψ, which is twice the value that is produced by subtracting the phase delay (phase characteristics) ϕ from the phase difference between the first basic signal x(n) and the canceling sound $\hat{C}\cdot y(n)$, which is opposite in phase with and has the same amplitude as the resonant noise d(n+1). The predetermined time $Z^{-m}$ actually is determined on a trial and error basis, based on the gain P of the filter 70 and a phase value Ψ at the time a test noise having the control frequency f is generated in the passenger compartment 14, wherein the generated test noise is silenced at the position of the microphone 18.

The adder 56 adds the first basic signal x(n) and the basic signal x"(n) into a combined signal {x(n)+x"(n)}. The adder 56 outputs the combined signal {x(n)+x"(n)} to the filter 70.

Based on the combined signal {x(n)+x"(n)} from the adder 56, the filter 70 generates a control signal y(n).

Specifically, as shown in FIG. 7, the filter 70 multiplies the first basic signal x(n) by the filter coefficient (gain) P in order to generate a product signal P·x(n), multiplies the second basic signal x"(n) by the filter coefficient (gain) P so as to generate a product signal P·x"(n), and combines the product signal P·x(n) and the product signal P·x"(n) into the control signal y(n).

The control signal y(n) and the first basic signal x(n) make up a triangle 206, whereas the control signal y(n) and the second basic signal x"(n) make up a triangle 208. Since the triangles 206, 208 have equal sides along the control signal y(n), equal sides (P) along the basic signals x(n), x'(n)k, and equal phase values Ψ, the triangles 206, 208 are congruent, because the pairs of corresponding sides and the included angle thereof are both equal. Accordingly, the control signal y(n) is expressed according to the following equation (9):

$$\begin{aligned} y(n) &= P\times x(n) + P\times x''(n) \\ &= P[\cos\{2\pi f\times t(n)\} + \cos[2\pi f\times\{t(n)+2\Psi\}]] \end{aligned} \tag{9}$$

Therefore, the filter 70 generates the control signal y(Nn) by multiplying {x(n)+x"(n)} by the filter coefficient (gain) P.

According to the second fundamental concept, as described above, when the microphone 18 outputs the canceling error signal e(n), the control signal y(n) (=−d(n+1)/$\hat{C}$), which acts to cancel out the resonant noise d(n+1) to be silenced at the position of the microphone 18, can be generated from the first basic signal x(n) and the second basic signal x"(n). Therefore, the canceling sound $\hat{C}\cdot y(n)$ can simply and accurately be generated without the need for a FIR adaptive filter. Hence, the ANC 204 is simpler in arrangement and less expensive to manufacture.

Specific examples of the ANC 204 (ANCs 10A through 10H according to first through eighth embodiments of the present invention) based on the first and second fundamental concepts (see FIGS. 1 through 7) shall be described below with reference to FIGS. 8 through 17. In each of these embodiments, parts which are identical to those of the first and second fundamental concepts are denoted using identical reference characters, and such parts will not be described in detail below.

Figure 8:
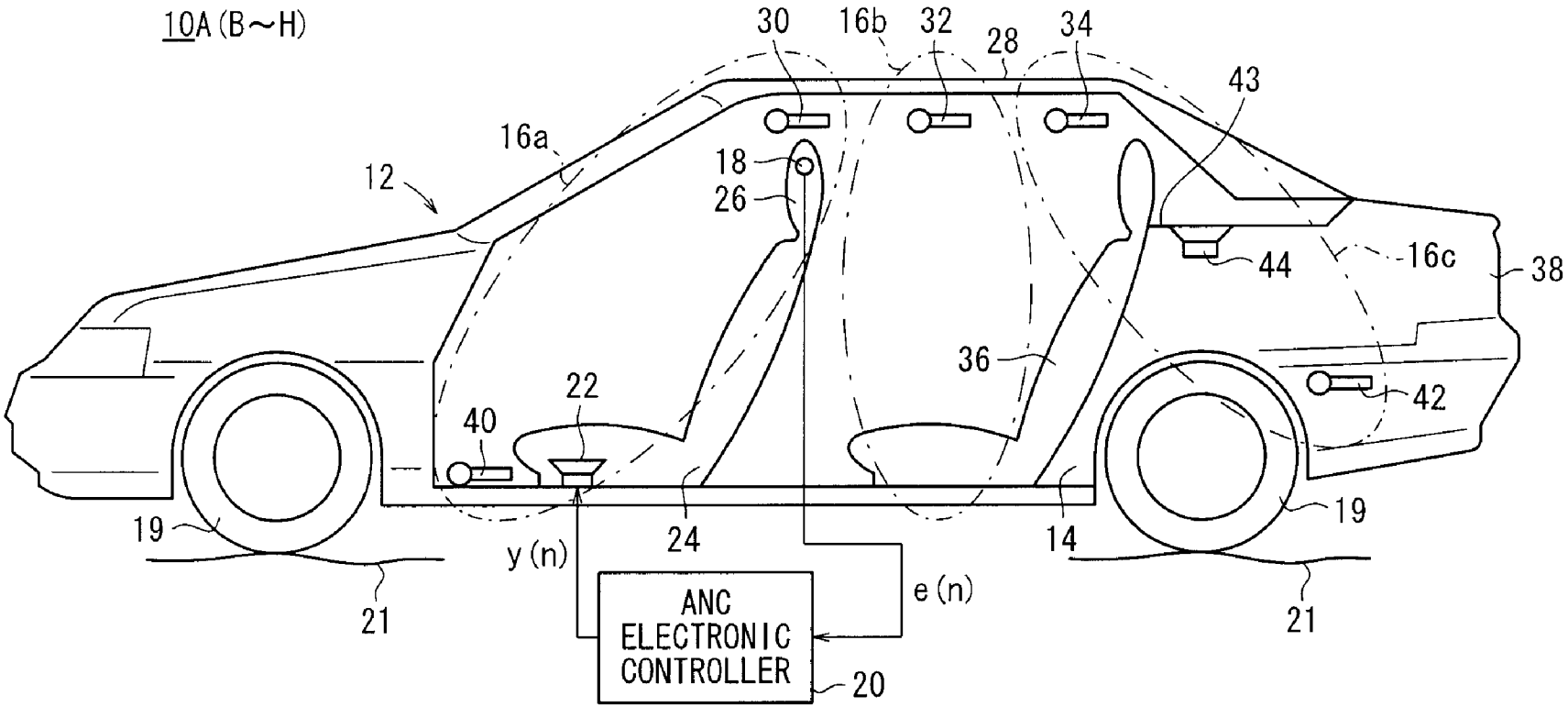
FIG. 8 is a schematic block diagram of an arrangement of an ANC according to a first embodiment of the present invention.
Figure 9:
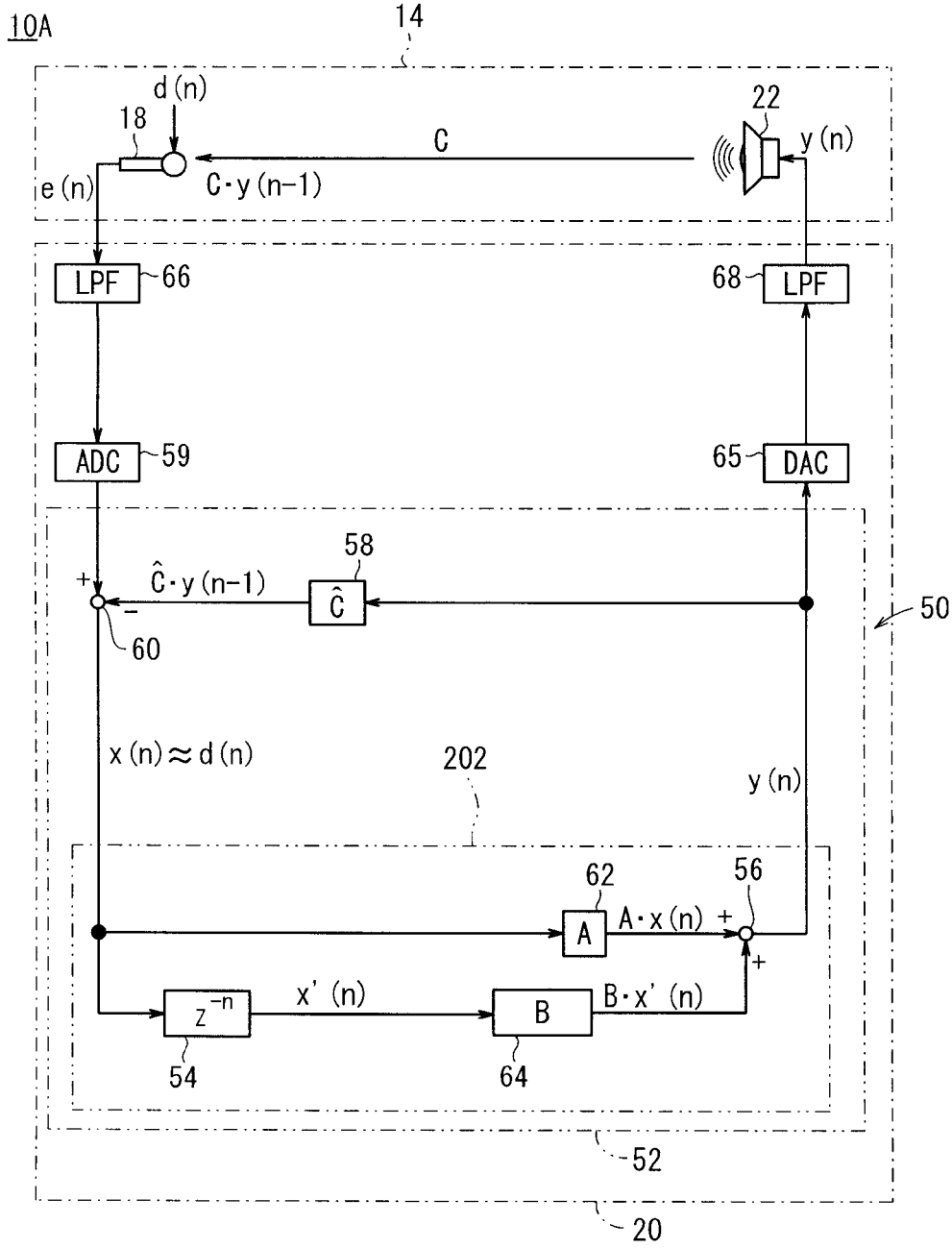
FIG. 9 is a schematic block diagram of an internal arrangement of an ANC electronic controller shown in FIG. 8.

FIGS. 8 and 9 show in block form an ANC 10A according to a first embodiment of the present invention, which is a specific example of the first fundamental concept (see FIGS. 1 through 5).

The ANC 10A is incorporated in a vehicle 12 as shown in FIG. 8. The ANC 10A basically comprises an ANC electronic controller 20 including a microcomputer 52 (see FIG. 9), a speaker 22 disposed in a given position in the vehicle 12, e.g., below a front seat 24, and a microphone 18 disposed near the position of an ear of a passenger, not shown, in a passenger compartment 14 of the vehicle 12, e.g., near the headrest 26 of the front seat 24.

The noise at the position of the microphone 18 includes (1) a noise generated in the passenger compartment 14 by vibrations of an engine (not shown) or the like in the vehicle 12, and a noise generated by a noise source, and a periodic noise {engine muffled sound (engine noise)} generated in the passenger compartment 14 by the above vibrations, and by vibrations of the noise source, and (2) an aperiodic low-frequency noise (drumming noise (road noise)) generated in the passenger compartment 14 due to contact between plural tires 19 and the road 21 while the vehicle 12 is running.

The road noise (2) is produced as a resonant sound (the resonant noise d(n) described above) having a high sound pressure level at a certain resonant frequency f due to the resonant characteristics in the passenger compartment 14. The resonant sound is a road noise having a central frequency equal to the resonant frequency f of 40 [Hz], for example. Specifically, the resonant sound refers to road noises that resonate within the passenger compartment 14 at the resonant frequency f, which is determined by the structure of the resonant chamber, i.e., the transverse and longitudinal dimensions of the passenger compartment 14. If the vehicle 12 is a passenger automobile, such as a sedan or the like, then the passenger compartment 14 has resonant characteristics represented by an acoustic mode in which the resonant sounds resonate at a frequency of about 40 [Hz] in the passenger compartment 14. Therefore, the resonant frequency f is a known frequency, which can be determined by the structure of the passenger compartment 14.

Since the road noise is strongly affected by the acoustic mode of the passenger compartment 14, the microphone 18 may be located in the passenger compartment 14 at an antinode 16*a* (an area in front of the front seat 24 in the passenger compartment 14) of the acoustic mode thereof. The acoustic mode also has other antinodes, including an antinode 16*b* extending between the front seat 24 and a rear seat 36, and an antinode 16*c* extending above the rear seat 36 and a trunk compartment 38 behind the rear seat 36. In order to detect road noises at the antinodes 16*a* through 16*c*, (1) other microphones 30, 32, 34 may be disposed near the roof 28, i.e., in a roof lining, not shown, provided on the inner surface of the roof 28, (2) a microphone 40 may be disposed near a lower end of the front seat 24 at the feet of the passenger seated in the front seat 24, and (3) a microphone 42 may be disposed in the trunk compartment 38. Accordingly, the microphones 30, 32, 34, 40, and 42 can output canceling error signals e(n) to the ANC electronic controller 20.

In addition, another speaker 44 may be disposed in a rear tray 43 behind the rear seat 36, for outputting a canceling sound.

In the following description, it will be assumed that only the microphone 18 and the speaker 22 are disposed in the passenger compartment 14.

As shown in FIG. 2, the ANC electronic controller 20 includes a control unit 50, a low-pass filter (LPF) 66 for passing and outputting a signal having a predetermined frequency or lower, from the canceling error signal e(n) output from the microphone 18, and an LPF 68 for passing and outputting, to the speaker 22, a signal having a predetermined frequency or lower, from the control signal y(n) output from the control unit 50. The control unit 50 has a sampling period set to a given period (e.g., 1/3000 [s]), which is much shorter than the delay time, e.g., 1/160 [s], of the delay filter 54.

The echo canceler 58 comprises a FIR filter or a notch filter having a fixed filter coefficient.

The LPF 66 comprises an antialiasing filter for removing folding noises having a predetermined frequency {a frequency higher than the control frequency f of the control signal y(n)} or higher from the canceling error signal e(n) input from the microphone 18. The LPF 66 then supplies the canceling error signal e(n) to the microcomputer 52.

The LPF 68 comprises a reconstruction filter for removing from the control signal y(n) signal components having frequencies higher than the control frequency f and which are generated when the control signal y(n) is converted into an analog signal by the DAC 65. The LPF 68 then outputs the control signal y(n), from which the high-frequency components have been removed, to the speaker 22.

Since the control unit 50 of the ANC 10A is capable of generating the control signal y(n) through a simpler digital signal processing method, the computational burden for generating the control signal y(n) is reduced. Further, since the control unit 50 consists of a simple arrangement using the microcomputer 52, which is relatively inexpensive, the ANC 10A can be manufactured inexpensively. As a result, the ANC 10A may be reduced in overall unit size, and can be combined with a digital audio unit in the vehicle 12.

Furthermore, since the LPF 66 comprises an antialiasing filter, although the control unit 50 is functionally realized by the microcomputer 52, which generates the control signal y(n) according to a digital signal processing method, the LPF 66 removes folding noises having a predetermined frequency or higher from the canceling error signal e(n), and then supplies the canceling error signal e(n) to the microcomputer 52. Accordingly, the control signal y(n) can be generated accurately in the microcomputer 52.

In addition, since the LPF 68 comprises a reconstruction filter, although the control unit 50 is functionally realized by the microcomputer 52, which generates the control signal y(n) according to a digital signal processing method, converts the control signal y(n) into an analog signal, and outputs the analog control signal Y(n) to the speaker 22, the LPF 68 removes high-frequency components from the analog control signal y(n), so that the analog control signal y(n) possesses a smooth waveform over time. As a result, the speaker 22 can output a high-quality canceling sound based on the control signal y(n), from which high-frequency components have been removed.

Figure 10:
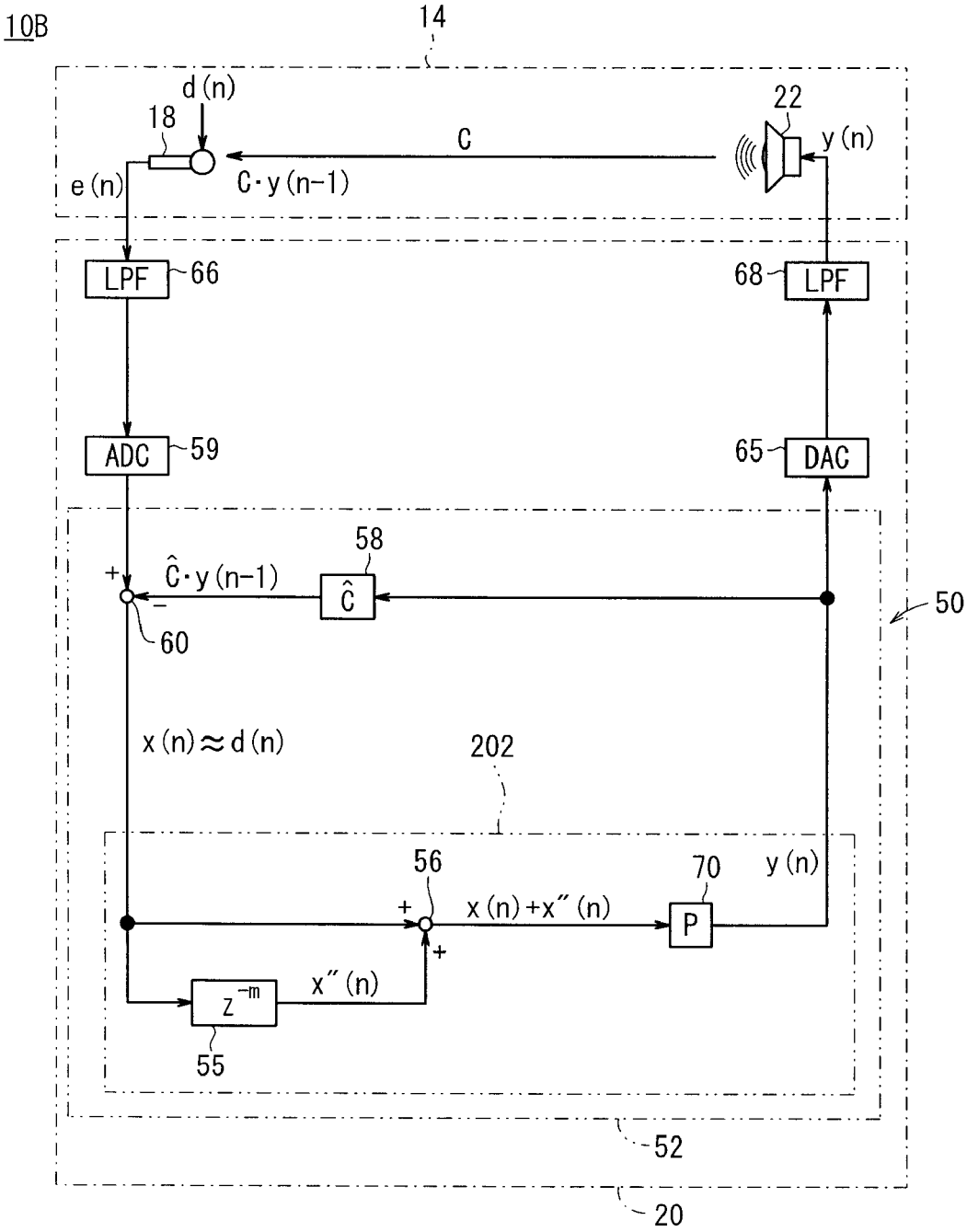
FIG. 10 is a schematic block diagram of an arrangement of an ANC according to a second embodiment of the present invention.

An ANC 10B according to a second embodiment, which is a specific example of the second fundamental concept (see FIGS. 6 and 7), will be described below with reference to FIG. 10.

The ANC 10B includes the filter 70 described above with reference to FIGS. 6 and 7. Therefore, the ANC 10B has one filter fewer than the filters used in the ANC 10A. As a result, the computational burden on the ANC 10B in generating the control signal y(n) is further reduced.

An ANC 10C according to a third embodiment will be described below with reference to FIGS. 11 and 12.

The ANC 10C differs from the ANC 10A (see FIG. 9) according to the first embodiment, in that a bandpass filter (BPF) 72 is connected to the input side of the microcomputer 52.

From the canceling error signal e(n) output from the LPF 66, the BPF 72 passes and outputs, to the microcomputer 52, only a signal within a predetermined frequency band, having a central frequency equal to the control frequency of 40 [Hz], for example, of the control signal y(n). In other words, from the canceling error signal e(n), the BPF 72 passes only a signal corresponding to a road noise (resonant sound) having a central frequency of about 40 [Hz], and outputs the signal through the ADC 59 to the microcomputer 52.

Figure 12:
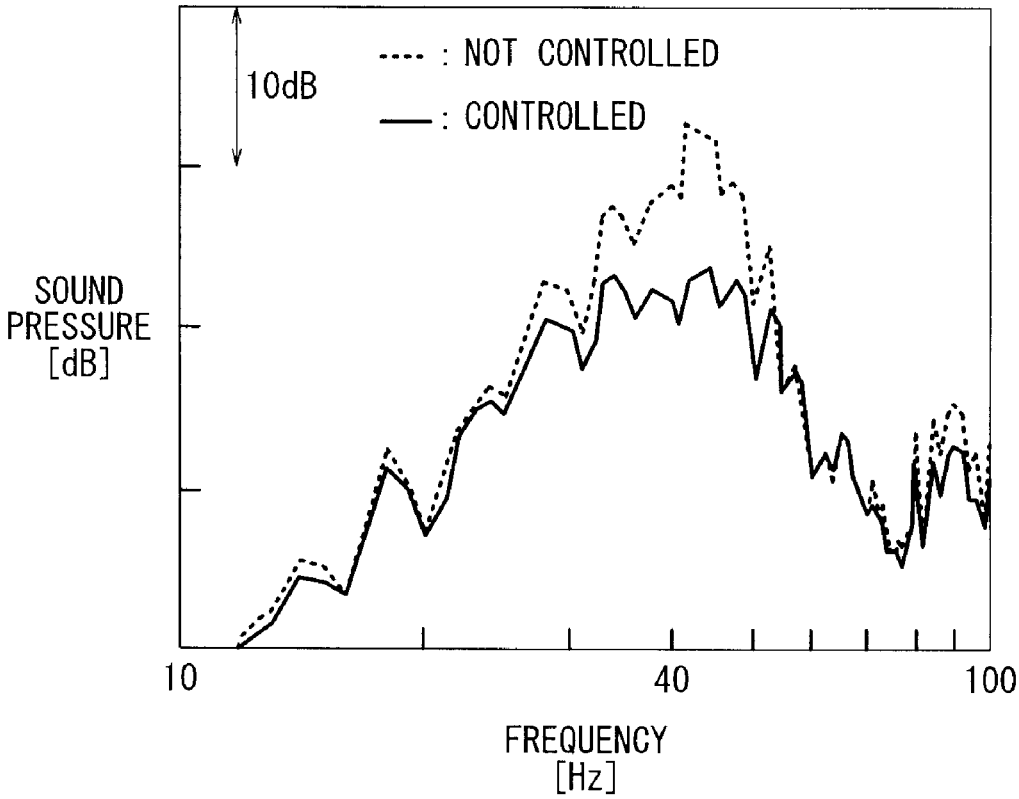
FIG. 12 is a characteristic diagram showing sound pressure vs. frequency characteristics of noise at the position of a microphone.

FIG. 12 shows sound pressure vs. frequency characteristics of a noise at the position of the microphone 18 (see FIG. 12). FIG. 12 illustrates a comparison between a characteristic curve plotted when a silencing control mode is carried out (CONTROLLED) at the position of the microphone 18 by the ANC 10C, for outputting the canceling sound from the speaker 22 into the passenger compartment 14, and a characteristic curve plotted when a silencing control mode is not carried out (NOT CONTROLLED) at the position of the microphone 18 by the ANC 10C. In the silencing control mode that is carried out (CONTROLLED), the control frequency f of the control signal y(n) is set at 40 [Hz].

Figure 11:
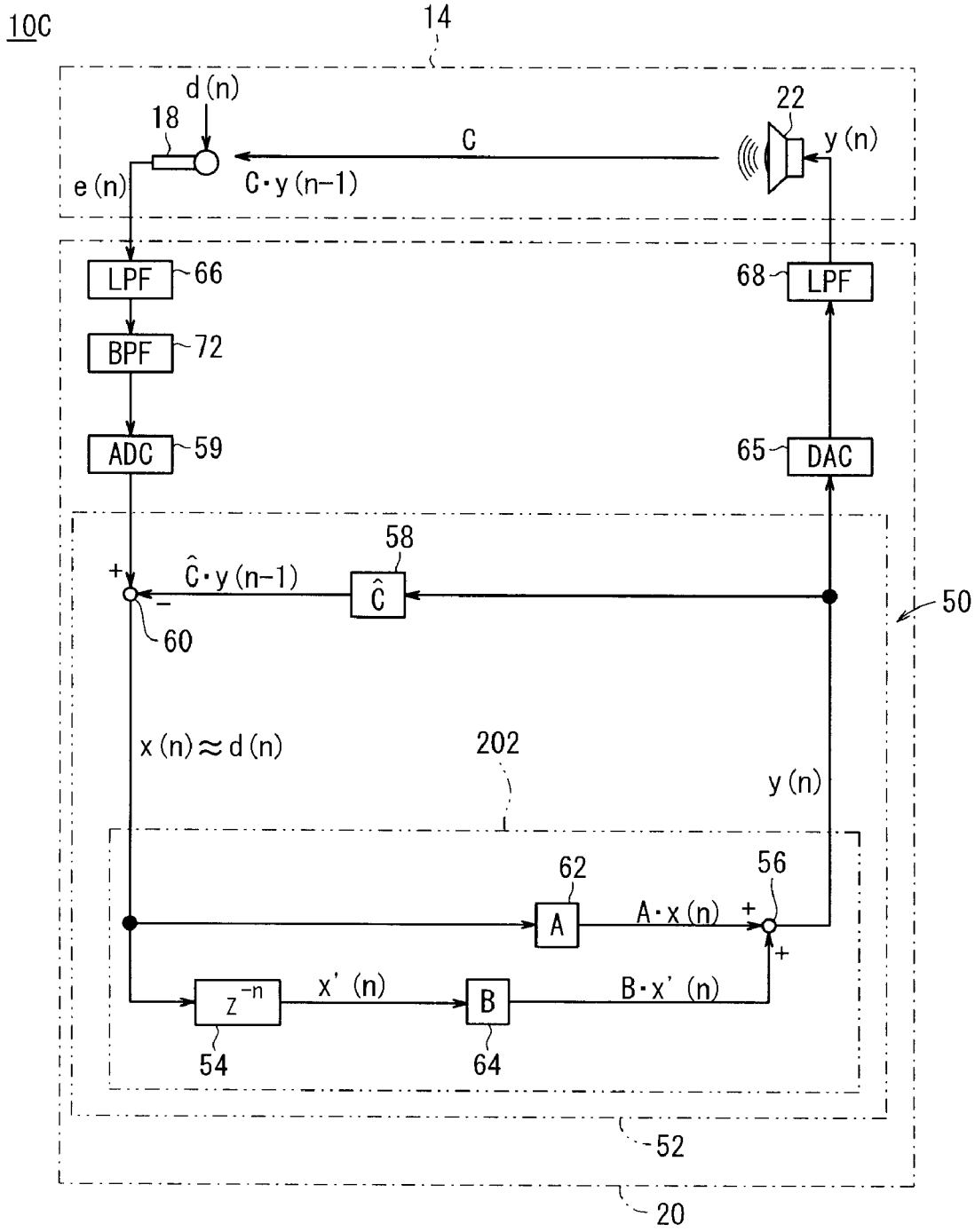
FIG. 11 is a schematic block diagram of an arrangement of an ANC according to a third embodiment of the present invention.

It can be seen from FIG. 11 that when the silencing control mode is carried out (CONTROLLED), the noise (road noise) at the position of the microphone 18 is reliably lowered within the frequency band from 30 [Hz] to 50 [Hz] around 40 [Hz].

The ANC 10C according to the third embodiment offers the same advantages as those of the ANC 10A (see FIG. 9) according to the first embodiment described above. In addition, although the control unit 50 is functionally realized by the microcomputer 52 for generating the control signal y(n) according to a digital signal processing method, since, from the canceling error signal e(n), the BPF 72 passes only a signal inside of a predetermined frequency band (a frequency band having a central frequency of 40 [Hz]), and then supplies the signal to the microcomputer 52, the microcomputer 52 can generate the control signal y(n) more accurately.

Figure 13:
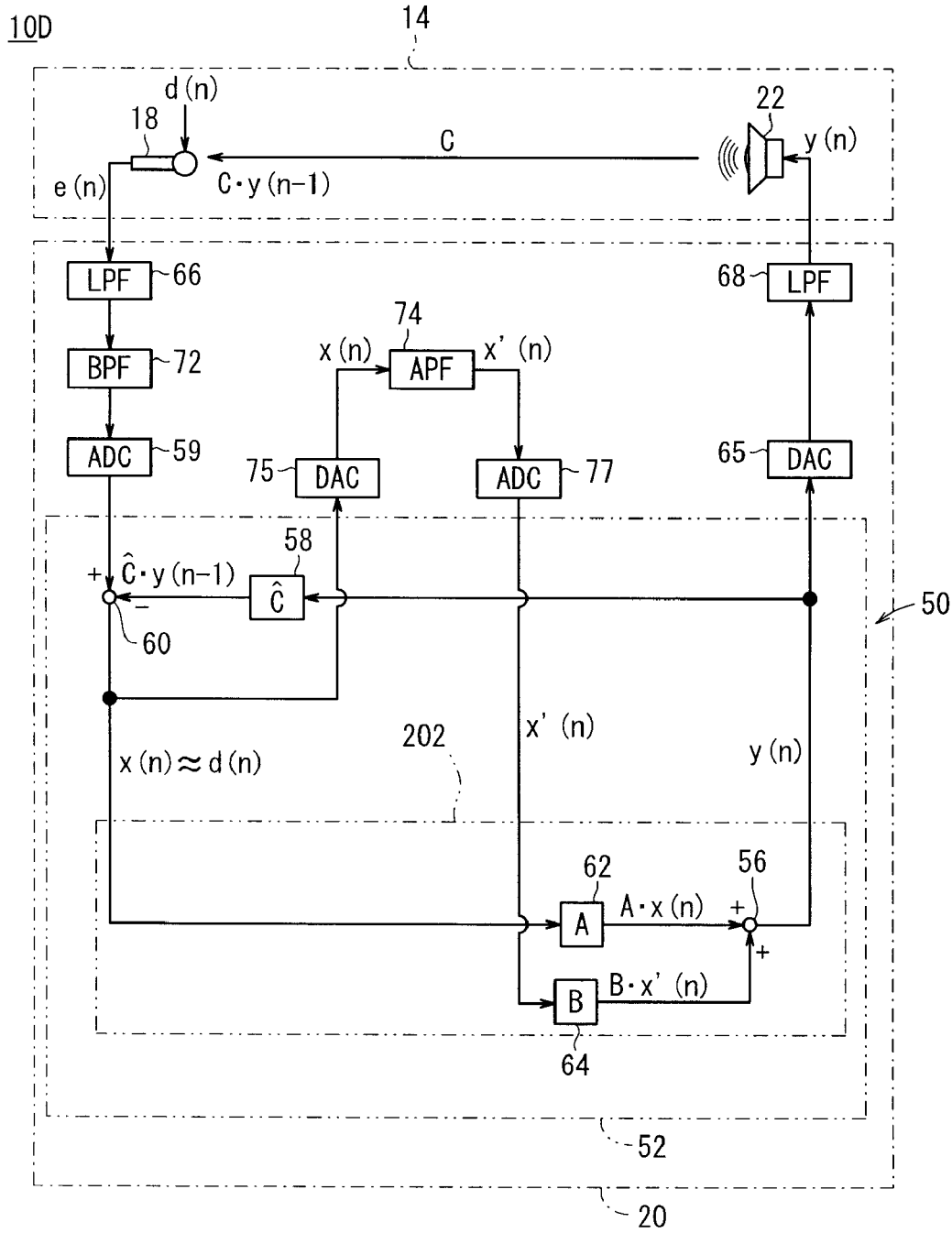
FIG. 13 is a schematic block diagram of an arrangement of an ANC according to a fourth embodiment of the present invention.

An ANC 10D according to a fourth embodiment will be described below with reference to FIG. 13.

The ANC 10D differs from the ANC 10C (see FIG. 11) according to the third embodiment, in that the ANC electronic controller 20 includes an allpass filter (APF) 74, instead of the delay filter 54, disposed outside of the microcomputer 52. The ANC 10D also includes a DAC (delay filter DAC) 75 and an ADC (delay filter ADC) 77.

The DAC 75 converts the first basic signal x(n) from a digital signal into an analog signal, and outputs the analog first basic signal x(n) to the APF 74.

The APF 74 comprises a delay filter having a phase delay at the control frequency f of the control signal y(n), which is set to a phase delay (90°) corresponding to a ¼ period of the control frequency f. Therefore, the APF 74 shifts the first basic signal x(n) input from the DAC 75 in phase by 90°, thereby generating a second basic signal x'(n), and outputs the second basic signal x'(n) to the ADC 77.

The ADC 77 converts the second basic signal x'(n) from an analog signal into a digital signal, and outputs the digital second basic signal x'(n) to the second filter 64.

The ANC 10D according to the fourth embodiment offers the same advantages as those of the ANC 10C (see FIG. 11) according to the third embodiment described above. In addition, since the delay filter comprises the APF 74, which is in the form of an analog circuit, the APF 74 does not need to be included in the microcomputer 52. Hence, the microcomputer 52 may be of a simpler design.

An ANC 10E according to a fifth embodiment will be described below with reference to FIG. 14.

In FIG. 9, an echo canceling signal $\hat{C}\cdot y(n)$ is generated by multiplying, by the corrective value $\hat{C}$, the control signal y(n), which is generated by combining the first corrective signal $A\cdot x(n)$ that is produced by multiplying the first basic signal x(n) by the filter coefficient (gain) A, and the second corrective signal $B\cdot x'(n)$ that is produced by multiplying the second basic signal x'(n) by the filter coefficient (gain) B $[\hat{C}\cdot y(n)=\hat{C}\{A\cdot x(n)+B\cdot x'(n)\}]$.

The echo canceling signal $\hat{C}\cdot y(n)$ also can be generated by multiplying the first basic signal x(n) by the corrective value $\hat{C}$, and thereafter by multiplying the product by the filter coefficient A, multiplying the second basic signal x'(n) by the corrective value $\hat{C}$, and thereafter by multiplying the product by the filter coefficient B, and finally combining $A\cdot\hat{C}\cdot x(n)$ and $B\cdot\hat{C}\cdot x'(n)$ $[A\cdot\hat{C}\cdot x(n)+B\cdot\hat{C}\cdot x'(n)=\hat{C}\{A\cdot x(n)+B\cdot x'(n)\}=\hat{C}\cdot y(n)]$.

Based on the latter alternative, it is possible to generate the echo canceling signal $\hat{C}\cdot y(n)$ according to a method of generating the first basic signal and the second basic signal at the position of the microphone 18, as disclosed in Japanese Laid-Open Patent Publication No. 2004-361721.

Specifically, the product of the first basic signal x(n) as a cosine signal and the corrective value $\hat{C}$ represents a first basic signal at the position of the microphone 18. The product of the second basic signal x'(n) as a sine signal and the corrective value $\hat{C}$ represents a second basic signal at the position of the microphone 18.

If a cosine corrective value based on the cosine value of the phase delay $\phi$ of the corrective value $\hat{C}$ is represented by Cr, and a sine corrective value based on the sine value of the phase delay $\phi$ of the corrective value $\hat{C}$ is represented by Ci, then the first basic signal at the position of the microphone 18 is expressed as a signal generated by subtracting the product $Ci\cdot x'(n)$ of the sine corrective value Ci and the second basic signal x'(n) from the product $Cr\cdot x(n)$ of the cosine corrective value Cr and the first basic signal x(n), i.e., a differential signal Sm $\{Sm=Cr\cdot x(n)-Ci\cdot x'(n)\}$. The second basic signal at the position of the microphone 18 is expressed as a signal generated by adding the product $Cr\cdot x'(n)$ of the cosine corrective value Cr and the second basic signal x'(n) to the product $Ci\cdot x(n)$ of the sine corrective value Ci and the first basic signal x(n), i.e., a sum signal Sp $\{Sp=Cr\cdot x'(n)+Ci\cdot x(n)\}$.

Therefore, the echo canceling signal $\hat{C}\cdot y(n)$ is generated by adding the product $A\cdot Sm$ of the differential signal Sm and the filter coefficient A to the product $B\cdot Sp$ of the sum signal Sp and the filter coefficient B.

Figure 14:
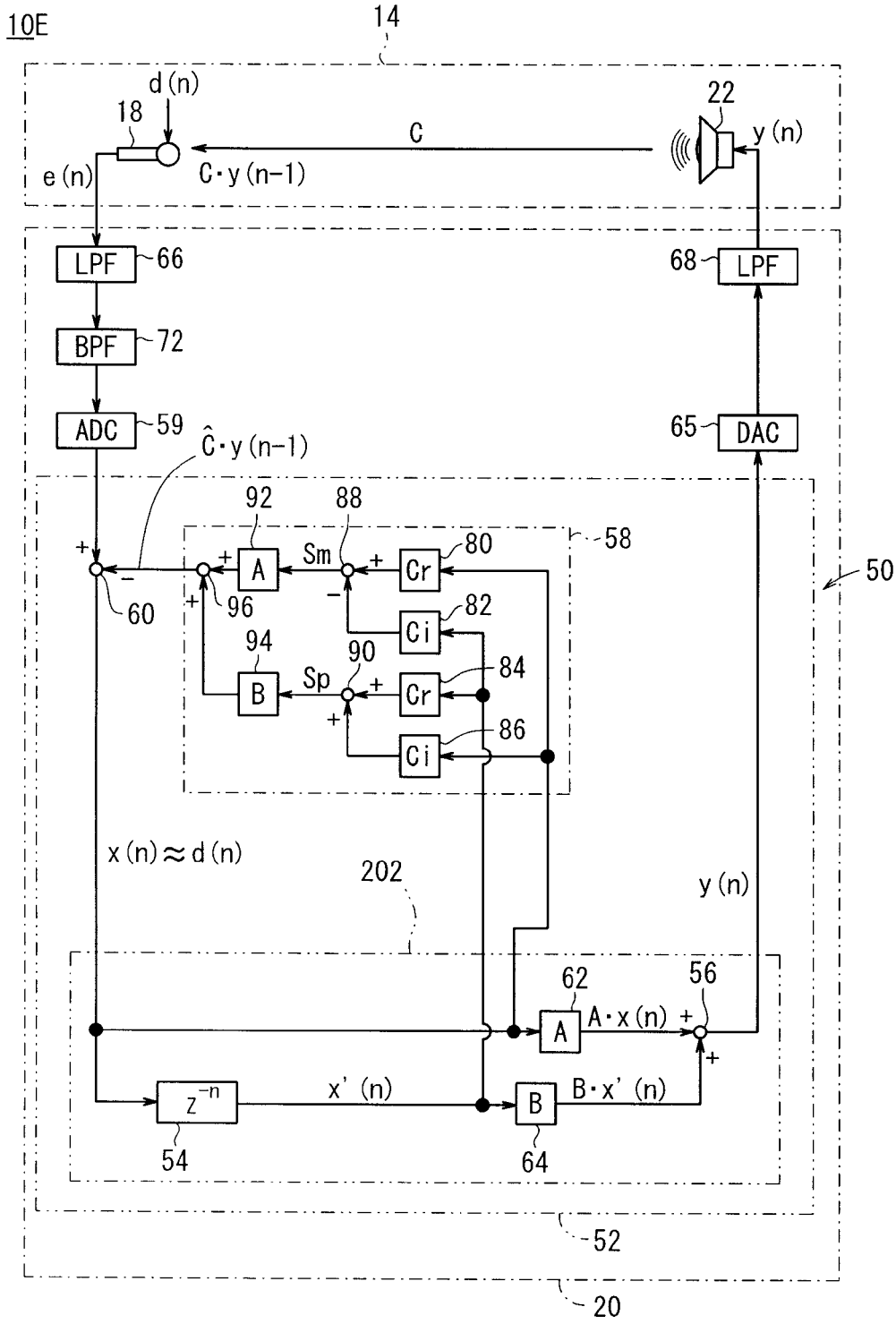
FIG. 14 is a schematic block diagram of an arrangement of an ANC according to a fifth embodiment of the present invention.

More specifically, as shown in FIG. 14, the echo canceler 58 comprises a first cosine corrector 80 and a second cosine corrector 84 each having the cosine corrective value Cr, a first sine corrector 82 and a second sine corrector 86 each having the sine corrective value Ci, a subtractor 88, a first adder 90, a first correcting filter 92 having the same filter coefficient (gain) A as the first filter 62, a second correcting filter 94 having the same filter coefficient (gain) B as the second filter 64, and a second adder 96.

The first cosine corrector 80 corrects the first basic signal x(n) with the cosine corrective value Cr, and then outputs the corrected signal $Cr\cdot x(n)$ to the subtractor 88. The first sine corrector 82 corrects the second basic signal x'(n) with the cosine corrective value Cr, and then outputs the corrected signal $Cr\cdot x'(n)$ to the subtractor 88. The second cosine corrector 84 corrects the second basic signal x'(n) with the cosine corrective value Cr, and then outputs the corrected signal $Cr\cdot x'(n)$ to the first adder 90. The second sine corrector 86 corrects the first basic signal x(n) with the sine corrective value Ci, and then outputs the corrected signal $Ci\cdot x(n)$ to the first adder 90.

The subtractor 88 subtracts the corrected signal $Cr\cdot x'(n)$ output from the first sine corrector 82 from the corrected signal $Cr\cdot x(n)$ output from the first cosine corrector 80, thereby generating the differential signal Sm. The first adder 90 adds the corrected signal $Cr\cdot x'(n)$ output from the second cosine corrector 84 to the corrected signal $Ci\cdot x(n)$ output from the second sine corrector 86, thereby generating the sum signal Sp.

The first correcting filter 92 corrects the differential signal Sm with the gain A, and outputs the corrected signal $A\cdot Sm$ to the second adder 96. The second correcting filter 94 corrects the sum signal Sp with the gain B, and outputs the corrected signal $B\cdot Sp$ to the second adder 96.

The second adder 96 adds the corrected signal $A\cdot Sm$ output from the first correcting filter 92 to the corrected signal $B\cdot Sp$ output from the second correcting filter 94, thereby generating an echo canceling signal $\hat{C}\cdot y(n)$, and outputs the echo canceling signal $\hat{C}\cdot y(n)$ in accordance with the timing of a sampling event (n+1).

The ANC 10E according to the fifth embodiment offers the same advantages as those of the ANC 10C (see FIG. 11) according to the third embodiment described above. In addition, the processing sequence for generating the echo canceling signal comprises a total of nine processes including arithmetic operations, i.e., four correcting processes carried out respectively by the first cosine corrector 80, the second cosine corrector 84, the first sine corrector 82, and the second sine corrector 86, one subtracting process carried out by the subtractor 88, one adding process carried out by the first adder 90, two correcting processes carried out respectively by the first correcting filter 92 and the second correcting filter 94, and one adding process carried out by the second adder 96. As a result, the amount of processing operations for generating the echo canceling signal is reduced. In other words, the echo canceling signals $\hat{C}\cdot y(n-1)$, $\hat{C}\cdot y(n)$ can be generated by a simpler arrangement, without the need for a FIR filter.

Figure 15:
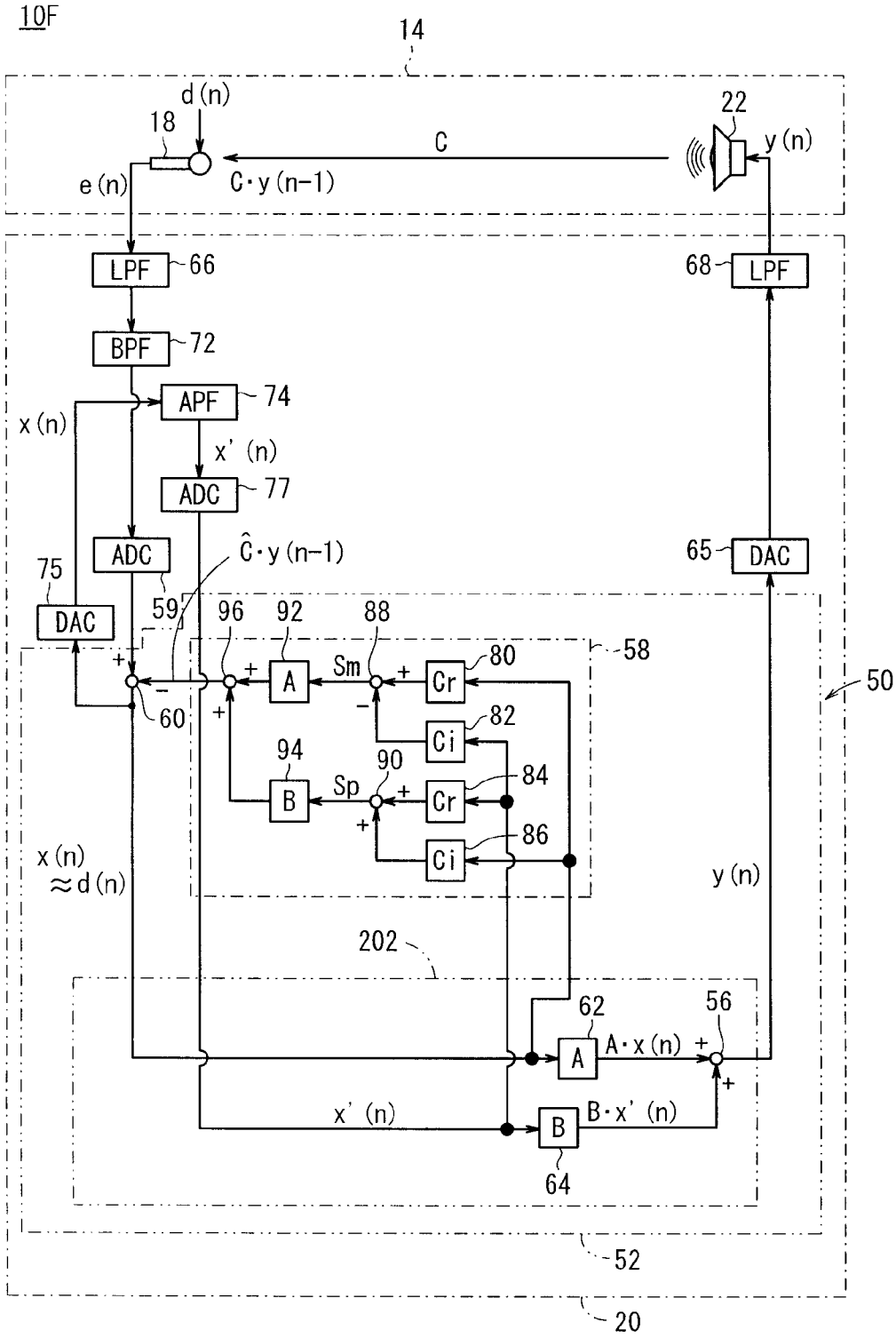
FIG. 15 is a schematic block diagram of an arrangement of an ANC according to a sixth embodiment of the present invention.

An ANC 10F according to a sixth embodiment will be described below with reference to FIG. 15.

The ANC 10F according to the sixth embodiment differs from the ANC 10E (see FIG. 14) according to the fifth embodiment, in that the ANC electronic controller 20 includes the APF 74, which is used as a delay filter.

The ANC 10F offers the same advantages provided by the APF 74 of the ANC 10D (see FIG. 13) according to the fourth embodiment, as well as the advantages of the ANC 10E (see FIG. 14) according to the fifth embodiment.

Figure 16:
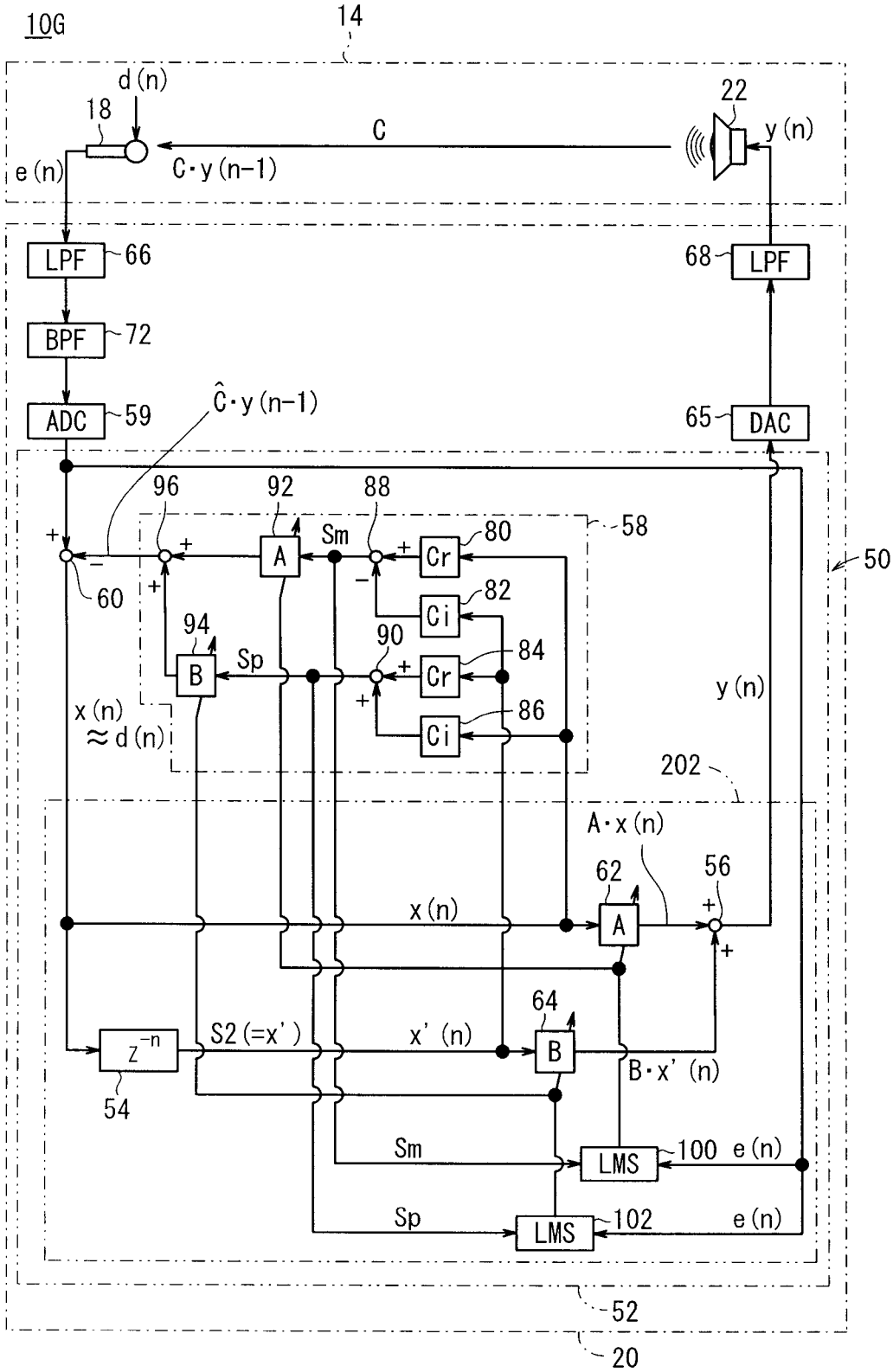
FIG. 16 is a schematic block diagram of an arrangement of an ANC according to a seventh embodiment of the present invention.

An ANC 10G according to a seventh embodiment will be described below with reference to FIG. 16.

The ANC 10G differs from the ANC 10E (see FIG. 14) according to the fifth embodiment, in that the microcomputer 52 (the control unit 50) includes a first filter coefficient updater 100 and a second filter coefficient updater 102, each of which comprises a least mean square algorithm (LMS) operator. Further, each of the first filter 62, the second filter 64, the first correcting filter 92, and the second correcting filter 94 comprises an adaptive filter, or more preferably an adaptive notch filter.

The first filter coefficient updater 100 performs an adaptive processing sequence for updating the filter coefficients A of the first filter 62 and the first correcting filter 92 in order to minimize the canceling error signal e(n) based on the differential signal Sm and the canceling error signal e(n), i.e., a processing sequence for calculating the filter coefficients A so as to minimize the canceling error signal e(n) based on the least mean square algorithm.

The second filter coefficient updater 102 performs an adaptive processing sequence for updating the filter coefficients B of the second filter 64 and the second correcting filter 94, so as to minimize the canceling error signal e(n) based on the sum signal Sp and the canceling error signal e(n).

The ANC 10G according to the seventh embodiment offers the same advantages as those of the ANC 10E (see FIG. 14) according to the fifth embodiment described above. In addition, even if the transfer characteristics C and the corrective value $\hat{C}$ vary due to mass-production-induced variations in the layout of the speaker 22 and the microphone 18 in the passenger compartment 14, or undergo changes due to aging or the like, since the filter coefficients A of the first filter 62 and the first correcting filter 92 as well as the filter coefficients B of the second filter 64 and the second correcting filter 94 are updated under an adaptive control, noise inside the passenger compartment 14 can still be silenced accurately.

Figure 17:
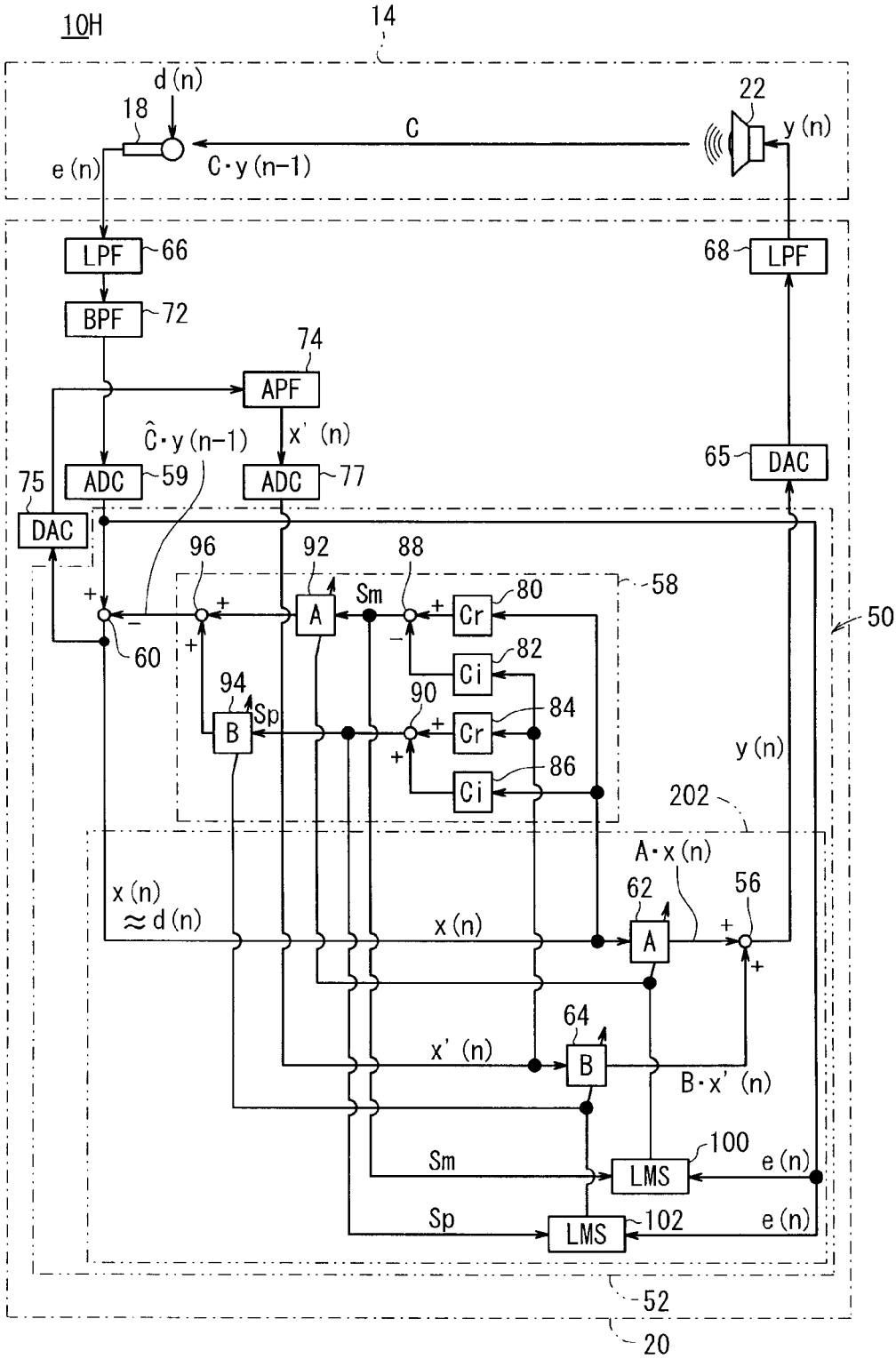
FIG. 17 is a schematic block diagram of an arrangement of an ANC according to an eighth embodiment of the present invention.

An ANC 10H according to an eighth embodiment will be described below with reference to FIG. 17.

The ANC 10H differs from the ANC 10G (see FIG. 16) according to the seventh embodiment, in that the ANC electronic controller 20 includes the APF 74 for use as a delay filter.

The ANC 10H offers the advantages provided by both the APF 74 of the ANC 10D (see FIG. 13) according to the fourth embodiment, as well as the advantages of the ANC 10G (see FIG. 16) according to the seventh embodiment.

Although certain preferred embodiments of the present invention have been shown and described in detail, it should be understood that various changes and modifications may be made therein without departing from the scope of the invention as set forth in the appended claims.

What is claimed is:

1. An active noise control apparatus comprising:

a control unit for generating a control signal for canceling out a noise in a passenger compartment of a vehicle;

a sound output device for outputting a canceling sound for canceling out said noise based on said control signal, into said passenger compartment; and a canceling error signal detector for outputting a canceling error signal representing a canceling error sound between said noise and said canceling sound to said control unit;

wherein said control unit comprises:

an A/D converter for converting said canceling error signal from an analog signal into a digital signal;

an echo canceller for correcting said control signal and thereby generating a digital echo canceling signal based on a corrective value corresponding to transfer characteristics between said sound output device and said canceling error signal detector;

a subtractor for generating a first basic signal by subtracting said digital echo canceling signal from the digital canceling error signal;

a delay filter for generating a second basic signal by delaying said first basic signal by a time corresponding to a ¼ period of a resonant frequency determined by resonant characteristics of said passenger compartment;

a first filter for correcting said first basic signal thereby generating a first corrective signal;

a second filter for correcting said second basic signal thereby generating a second corrective signal;

an adder for generating the control signal by combining said first corrective signal and said second corrective signal; and a D/A converter for converting said control signal from a digital signal into an analog signal and outputting the analog control signal to said sound output device.

2. An active noise control apparatus comprising:

a control unit for generating a control signal for canceling out a noise in a passenger compartment of a vehicle;

a sound output device for outputting a canceling sound for canceling out said noise based on said control signal, into said passenger compartment; and a canceling error signal detector for outputting a canceling error signal representing a canceling error sound between said noise and said canceling sound to said control unit, wherein said control unit comprises:

an A/D converter for converting said canceling error signal from an analog signal into a digital signal;

an echo canceller for correcting said control signal and thereby generating a digital echo canceling signal based on a corrective value corresponding to transfer characteristics between said sound output device and said canceling error signal detector;

a subtractor for generating a first basic signal by subtracting said digital echo canceling signal from the digital canceling error signal;

a delay filter for generating a second basic signal by delaying said first basic signal by a predetermined time based on a resonant frequency determined by resonant characteristics of said passenger compartment;

an adder for combining said first basic signal and said second basic signal into a combined signal;

an amplitude adjuster for adjusting an amplitude of said combined signal with a predetermined gain to a predetermined magnitude, thereby generating said control signal; and a D/A converter for converting said control signal from a digital signal into an analog signal and outputting the analog control signal to said sound output device.

3. An active noise control apparatus according to claim 1, wherein said echo canceller comprises:

a first cosine corrector for correcting said first basic signal with a cosine value of phase characteristics of said transfer characteristics and outputting a corrected signal;

a first sine corrector for correcting said second basic signal with a sine value of said phase characteristics and outputting a corrected signal;

a subtractor for subtracting the corrected signal output from said first sine corrector from the corrected signal output from said first cosine corrector thereby to generate a differential signal;

a second cosine corrector for correcting said second basic signal with said cosine value and outputting a corrected signal;

a second sine corrector for correcting said first basic signal with said sine value and outputting a corrected signal;

a first adder for adding the corrected signal output from said second cosine corrector and the corrected signal output from said second sine corrector into a sum signal;

a first correcting filter for correcting said differential signal and outputting a corrected signal;

a second correcting filter for correcting said sum signal and outputting a corrected signal; and a second adder for adding the corrected signal from said first correcting filter and the corrected signal from said second correcting filter together with said echo canceling signal, and outputting said echo canceling signal to said subtractor.

4. An active noise control apparatus according to claim 3, wherein each of said first filter, said second filter, said first correcting filter, and said second correcting filter comprises an adaptive filter; and said control unit further comprises:

a first filter coefficient updater for updating respective filter coefficients of said first filter and said first correcting filter, so as to minimize said canceling error signal based on said canceling error signal and said differential signal; and a second filter coefficient updater for updating respective filter coefficients of said second filter and said second correcting filter, so as to minimize said canceling error signal based on said canceling error signal and said sum signal.

5. An active noise control apparatus according to claim 4, wherein each of said first filter, said second filter, said first correcting filter, and said second correcting filter comprises an adaptive notch filter.

6. An active noise control apparatus according to claim 1, wherein said control unit further comprises:

a delay filter D/A converter and a delay filter A/D converter;

said delay filter comprises an allpass filter for equalizing a phase delay at a control frequency of said control signal to a phase delay corresponding to a ¼ period of said control frequency;

said delay filter D/A converter converts said first basic signal from a digital signal into an analog signal and outputs the analog first basic signal to said delay filter; and said delay filter A/D converter converts said second basic signal from an analog signal into a digital signal and outputs the digital second basic signal to said second filter.

7. An active noise control apparatus according to claim 1, further comprising:

an antialiasing filter for passing only a signal having a predetermined frequency or lower, and outputting said signal to said control unit, wherein said predetermined frequency is higher than a control frequency of said control signal.

8. An active noise control apparatus according to claim 1, further comprising:

a reconstruction filter for removing a high-frequency component from said control signal output from said control unit, and outputting the control signal from which the high-frequency component has been removed to said sound output device, wherein said high-frequency component has a frequency higher than a control frequency of said third control signal.

9. An active noise control apparatus according to claim 1, further comprising:

a bandpass filter for passing and outputting to said control unit, from within said canceling error signal, only a signal in a predetermined frequency band and having a central frequency equal to a control frequency of said control signal.

10. An active noise control apparatus according to claim 1, wherein said canceling error signal detector is disposed at an antinode of an acoustic mode of said passenger compartment.

11. An active noise control apparatus according to claim 1, wherein said control unit has a sampling period set to a period shorter than a time corresponding to said ¼ period in said delay filter.

12. An active noise control apparatus according to claim 1, wherein said sound output device outputs a canceling sound for canceling a resonant noise having said resonant frequency at the position of said canceling error signal detector, based on said control signal.

13. An active noise control apparatus according to claim 1, further comprising:

a signal transfer characteristics measuring device connected between an output terminal of said subtractor and an output terminal of said adder, for measuring said transfer characteristics based on a test signal output from said adder to said D/A converter, and a signal output from said subtractor to said first filter and said delay filter, wherein said transfer characteristics measured by said signal transfer characteristics measuring device are set as said corrective value in said echo canceller.

14. An active noise control apparatus according to claim 1, wherein, when the time corresponding to said ¼ period is m times a sampling period in said control unit, said delay filter comprises (m+1) buffers; and wherein said delay filter successively stores instantaneous values of said first basic signal output from said subtractor in respective sampling events into said buffers, respectively, reads the stored instantaneous value from the buffer which stores the instantaneous value that is m sampling events prior to one of the buffers, and outputs the read instantaneous value as said second basic signal.

15. An active noise control apparatus according to claim 1, wherein, when the time corresponding to said ¼ period is m times a sampling period in said control unit, said delay filter comprises m buffers; and wherein said delay filter successively stores instantaneous values of said first basic signal output from said subtractor in respective sampling events into said buffers, respectively, reads from said buffers an oldest instantaneous value stored in said buffers at the time of storing said instantaneous values, and outputs the read oldest instantaneous value as said second basic signal.

* * * * *